US009888830B2

(12) United States Patent
Hirsh et al.

(10) Patent No.: US 9,888,830 B2
(45) Date of Patent: Feb. 13, 2018

(54) DISHWASHER UTENSIL BASKET

(71) Applicant: Whirlpool Corporation, Benton Harbor, MI (US)

(72) Inventors: Michael I. Hirsh, Stevensville, MI (US); Sujit S. Naik, Pune (IN); Hrushikesh C. Prabhu, Pune (IN); Mohan Takale, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 14/657,324

(22) Filed: Mar. 13, 2015

(65) Prior Publication Data

US 2015/0374203 A1 Dec. 31, 2015

Related U.S. Application Data

(60) Provisional application No. 62/016,702, filed on Jun. 25, 2014.

(51) Int. Cl.
*A47L 15/50* (2006.01)

(52) U.S. Cl.
CPC ..... *A47L 15/502* (2013.01)

(58) Field of Classification Search
CPC ..... A47L 15/50; A47L 15/502; A47L 15/506; B65D 7/14; B65D 7/16; B65D 7/18; B65D 7/20
USPC ..... 220/488
See application file for complete search history.

(56) References Cited

U.S. PATENT DOCUMENTS

| | | | | |
|---|---|---|---|---|
| 4,157,145 | A * | 6/1979 | Jordan | A47L 15/502 220/487 |
| 8,522,998 | B2 * | 9/2013 | Crookshanks | A47L 15/502 211/41.8 |
| 2007/0119801 | A1 * | 5/2007 | Miele | A47L 15/502 211/70.7 |
| 2010/0200028 | A1 | 8/2010 | Buehlmeyer et al. | |
| 2013/0233353 | A1 * | 9/2013 | Vacca | A47L 15/501 134/25.2 |
| 2016/0128543 | A1 * | 5/2016 | Alwin | A47L 15/502 211/70.7 |

FOREIGN PATENT DOCUMENTS

| | | | |
|---|---|---|---|
| DE | 9016901 | U1 | 3/1991 |
| EP | 0385877 | B1 | 8/1993 |
| EP | 2096980 | B1 | 3/2010 |
| GB | 2303055 | A | 2/1997 |
| WO | 2011006727 | A1 | 1/2011 |
| WO | 2013098019 | A1 | 7/2013 |

* cited by examiner

*Primary Examiner* — Andrew Perreault
(74) *Attorney, Agent, or Firm* — McGarry Bair PC

(57) ABSTRACT

A dishwasher utensil basket includes a mechanism for unloading multiple utensils at once without the user having to directly handle the utensils. The mechanism can include a grid that is loaded with utensils for treatment. The basket can include multiple zones for loading utensils, each provided with an individually-operable unloading mechanism. A user can unload the basket by holding a handle of the basket in one hand and squeezing an actuator of the mechanism toward the handle using the thumb of the same hand.

13 Claims, 30 Drawing Sheets

DISHWASHER UTENSIL BASKET

CROSS-REFERENCE TO RELATED APPLICATIONS

This application claims the benefit of U.S. Provisional Patent Application No. 62/016,702, filed Jun. 25, 2014, which is incorporated herein by reference in its entirety.

BACKGROUND OF THE INVENTION

Contemporary automatic dishwashers for use in a typical household include a tub defining a treating chamber and a spraying system for recirculating liquid throughout the tub to remove soils from dishes and utensils. Upper and lower racks for holding dishes to be cleaned are typically provided within the treating chamber. A utensil basket for holding utensils, silverware, etc. is also usually provided and normally removably mounts to the door or within the lower rack. The utensil basket is configured to hold elongated utensils such as knives, spoons, forks, and spatulas in a vertical orientation as well as smaller objects that might fall through the racks.

BRIEF DESCRIPTION OF THE INVENTION

In one aspect of the invention, a utensil basket for a dishwasher includes at least one compartment, a grid associated with the at least one compartment and having a plurality of spaced tines defining open-ended slots sized to receive individual utensils in an upright position with a handle of the utensil located within the at least one compartment, and a loading/unloading mechanism operably coupled to the grid and operable between a loading position in which utensils can be loaded into the grid and an unloading position in which utensils can be removed from the basket, wherein the movement of the mechanism from the loading position to the unloading position effects the relative movement of the grid and any utensils within the basket such that the handles of the any utensils pass through the open-ended slots of the grid and are free for grasping and removal by a user.

DESCRIPTION OF EMBODIMENTS OF THE INVENTION

Figure 1:
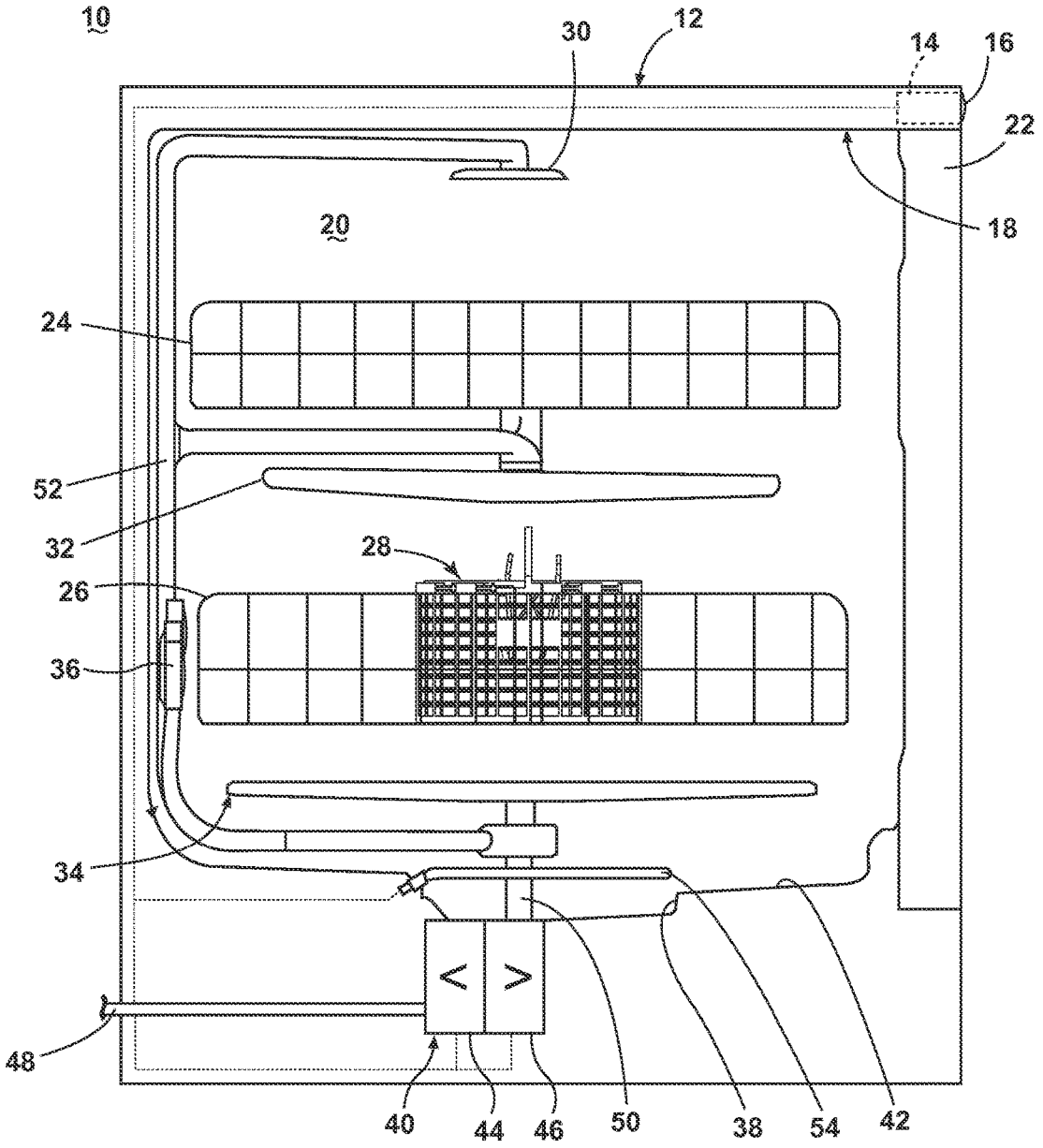
FIG. 1 is a schematic, cross-sectional view of a dishwasher with a spray system according to one embodiment of the invention.

In FIG. 1, an automated dishwasher 10 according to one embodiment of the invention is illustrated. The dishwasher 10 can treat dishes according to an automatic cycle of operation. Depending on whether the dishwasher 10 is a stand-alone or built-in, a cabinet 12 of the dishwasher 10 may be a chassis/frame with or without panels attached, respectively. The dishwasher 10 shares many features of a conventional automatic dishwasher, which will not be described in detail herein except as necessary for a complete understanding of the invention. While the present invention is described in terms of a conventional dishwashing unit, it could also be implemented in other types of dishwashing units, such as in-sink dishwashers, multi-tub dishwashers, or drawer-type dishwashers.

A controller 14 may be located within the cabinet 12 and may be operably coupled with various components of the dishwasher 10 to implement one or more cycles of operation. A control panel or user interface 16 may be provided on the dishwasher 10 and coupled with the controller 14. The user interface 16 may include operational controls such as dials, lights, switches, and displays enabling a user to input commands, such as a cycle of operation, to the controller 14 and receive information.

A tub 18 is located within the cabinet 12 and at least partially defines a treating chamber 20 with an access opening in the form of an open face. A cover, illustrated as a door 22, may be hingedly mounted to the cabinet 12 and may move between an opened position, wherein the user may access the treating chamber 20, and a closed position, as shown in FIG. 1, wherein the door 22 covers or closes the open face of the treating chamber 20.

Dish holders in the form of upper and lower racks 24, 26 are located within the treating chamber 20 and receive dishes for treatment. The racks 24, 26 are mounted for slidable movement in and out of the treating chamber 20 for ease of loading and unloading. As used in this description, the term "dish(es)" is intended to be generic to any item, single or plural, that may be treated in the dishwasher 10, including, without limitation; utensils, plates, pots, bowls, pans, glassware, and silverware.

An additional utensil holder, such as a utensil basket 28, is also located within the treating chamber 20 and receives utensils for being treated. As used in this description, the term "utensil(s)" is intended to be generic to any item, single or plural, that may be placed in the utensil basket 28 for treatment in the dishwasher 10, including, without limitation; forks, spoons, knives, chopsticks, spatulas, tongs, whisks, etc. The utensil basket 28 can be removably mounted to the lower rack 26. As another option, the utensil basket 28 could be positioned in the upper rack 24. As yet another option, the utensil basket 28 could be provided on the interior of the door 22 instead of either rack 24, 26.

A spraying system may be provided for spraying liquid into the treating chamber 20 and is illustrated in the form of an upper sprayer 30, a mid-level rotatable sprayer 32, a lower rotatable sprayer 34, and a spray manifold 36. The upper sprayer 30 may be located above the upper rack 24 and is illustrated as a fixed spray nozzle that sprays liquid downwardly within the treating chamber 20. The mid-level rotatable sprayer 32 is located between the upper rack 24 and the lower rack 26 and is illustrated as a rotating spray arm. The mid-level spray arm 32 may provide a liquid spray upwardly through the bottom of the upper rack 24. The mid-level rotatable sprayer 32 may optionally also provide a liquid spray downwardly onto the lower rack 26 and utensil basket 28. The lower rotatable sprayer 34 is located underneath the lower rack 26 and may provide a liquid spray upwardly through the bottom of the lower rack 26 and utensil basket 28.

The spray manifold 36 may be fixedly mounted to the tub 18 adjacent to the lower rack 26 and may provide a liquid spray laterally through a side of the lower rack 26. The spray manifold 36 may not be limited to this position; rather, the spray manifold 36 may be located in virtually any part of the treating chamber 20. While not illustrated herein, the spray manifold 36 may include multiple spray nozzles having apertures configured to spray wash liquid towards the lower rack 26. The spray nozzles may be fixed or rotatable with respect to the tub 18.

A liquid recirculation system may be provided for recirculating liquid from the treating chamber 20 to the spraying system. The recirculation system may include a sump 38 and a pump assembly 40. The sump 38 collects the liquid sprayed in the treating chamber 20 and may be formed by a sloped or recessed portion of a bottom wall 42 of the tub 18. The pump assembly 40 may include both a drain pump 44 and a recirculation pump 46.

The drain pump 44 may draw liquid from the sump 38 and pump the liquid out of the dishwasher 10 to a household drain line 48. The recirculation pump 46 may draw liquid from the sump 38 and pump the liquid to the spraying system to supply liquid into the treating chamber 20. While the pump assembly 40 is illustrated as having separate drain and recirculation pumps 44, 46 in an alternative embodiment, the pump assembly 40 may include a single pump configured to selectively supply wash liquid to either the spraying system or the drain line 48, such as by configuring the pump to rotate in opposite directions, or by providing a suitable valve system. While not shown, a liquid supply system may include a water supply conduit coupled with a household water supply for supplying water to the sump 38.

As shown herein, the recirculation pump 46 has an outlet conduit 50 in fluid communication with the spraying system for discharging wash liquid from the recirculation pump 46 to the sprayers 30-36. As illustrated, liquid may be supplied to the spray manifold 36, mid-level rotatable sprayer 32, and upper sprayer 30 through a supply tube 52 that extends generally rearward from the recirculation pump 46 and upwardly along a rear wall of the tub 18. While the supply tube 52 ultimately supplies liquid to the spray manifold 36, mid-level rotatable sprayer 32, and upper sprayer 30, it may fluidly communicate with one or more manifold tubes that directly transport liquid to the spray manifold 36, mid-level rotatable sprayer 32, and upper sprayer 30. Further, diverters (not shown) may be provided within the spraying system such that liquid may be selectively supplied to each of the sprayers 30-36. The sprayers 30-36 spray water and/or treating chemistry onto the dish racks 24, 26 and utensil basket 28 (and hence any dishes positioned thereon) to effect a recirculation of the liquid from the treating chamber 20 to the liquid spraying system to define a recirculation flow path.

A heating system having a heater 54 may be located within or near the sump 38 for heating liquid contained in the sump 38. A filtering system (not shown) may be fluidly coupled with the recirculation flow path for filtering the recirculated liquid.

Figure 2:
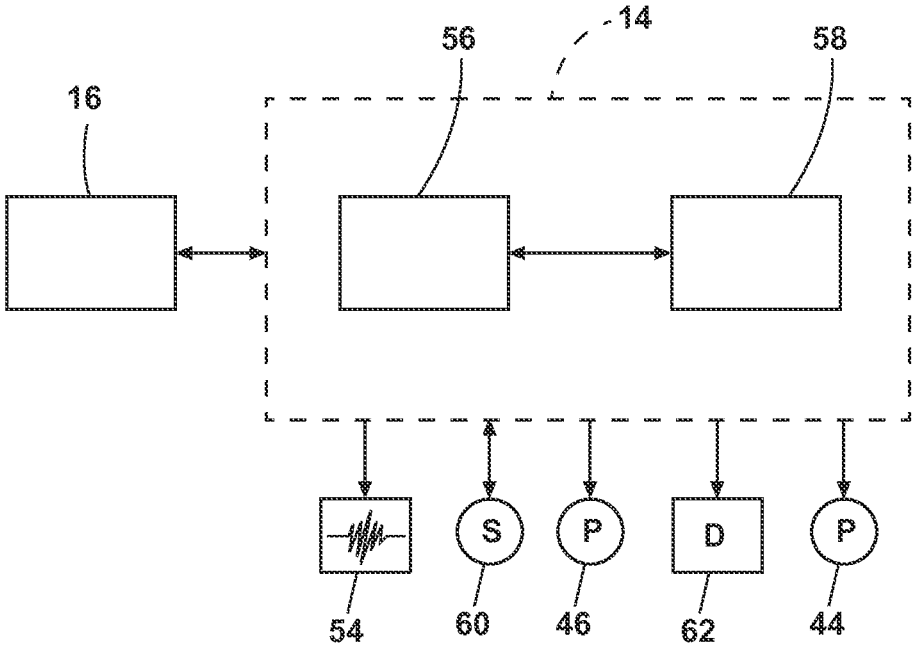
FIG. 2 is a schematic view of a control system of the dishwasher of FIG. 1.

As illustrated in FIG. 2, the controller 14 may be provided with a memory 56 and a central processing unit (CPU) 58. The memory 56 may be used for storing control software that may be executed by the CPU 58 in completing a cycle of operation using the dishwasher 10 and any additional software. For example, the memory 56 may store one or more pre-programmed cycles of operation that may be selected by a user and completed by the dishwasher 10. A cycle of operation for the dishwasher 10 may include one or more of the following steps: a wash step, a rinse step, and a drying step. The wash step may further include a pre-wash step and a main wash step. The rinse step may also include multiple steps such as one or more additional rinsing steps performed in addition to a first rinsing. The amounts of water and/or rinse aid used during each of the multiple rinse steps may be varied. The drying step may have a non-heated drying step (so called "air only"), a heated drying step or a combination thereof. These multiple steps may also be performed by the dishwasher 10 in any desired combination.

The controller 14 may be operably coupled with one or more components of the dishwasher 10 for communicating with and controlling the operation of the components to complete a cycle of operation. For example, the controller 14 may be coupled with the recirculation pump 46 for circulation of liquid in the tub 18 and the drain pump 44 for drainage of liquid in the tub 18. The controller 14 may also be operably coupled to the heater 54. Further, the controller 14 may also be coupled with one or more optional sensors 60. Non-limiting examples of optional sensors 60 that may be communicably coupled with the controller 14 include a moisture sensor, a door sensor, a temperature sensor, a detergent and rinse aid presence/type sensor(s). The controller 14 may also be coupled to a dispenser 62, which may dispense a detergent during the wash step of the cycle of operation or a rinse aid during the rinse step of the cycle of operation.

Figure 3:
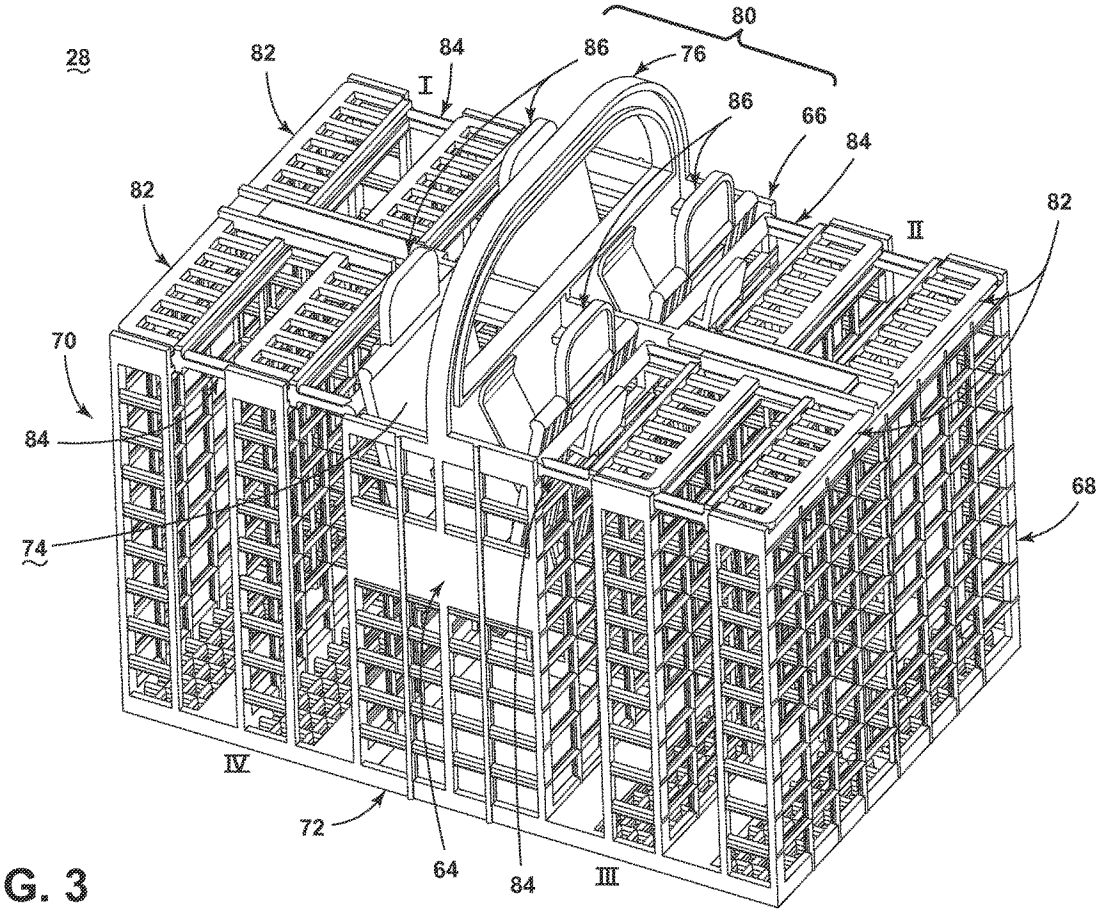
FIG. 3 is a perspective view of a utensil basket having a loading/unloading mechanism.

FIG. 3 is a perspective view of one embodiment of the utensil basket 28. The basket 28 includes a front wall 64 and a rear wall 66 joined by opposing side walls 68, 70 and a bottom wall 72 to define a container having an open top 74. The walls can be made from a molded plastic generally having an open latticework including a plurality of openings such that wash liquid can enter the basket 28 and contact utensils in the basket 28. A handle 76 extends upwardly from the open top 74, and is shown here as spanning the width of the basket 28 between the front and rear walls 64, 66. The handle 76 facilitates removal of the basket 28 from the dishwasher 10. As shown herein, the basket 28 can include a single molded body defining the walls 64, 66, 68, 70, 72 and an open top 74 of the basket 28, and can also include the handle 76.

The basket 28 is provided with a plurality of interior partitions that define a plurality of storage zones for separating utensils during a cycle of operation and for organized loading and unloading of utensils in the basket 28. The illustrated basket 28 is divided into portions, such as quadrants I-IV, with each quadrant I-IV defining a storage zones for utensils. Each quadrant I-IV has a loading/unloading mechanism 80 for easy and organized loading and unloading of the utensil basket 28. The loading/unloading mechanism 80 includes a loading grid 82 for loading utensils in an organized manner, a utensil mover 84 for moving the utensils between a loading position in which the utensils can be loaded into the loading grid 82 and an unloading position in which the utensils can be removed from the basket 28, and an actuator 86 for moving the utensil mover 84 between the loading and unloading position.

Figure 4:
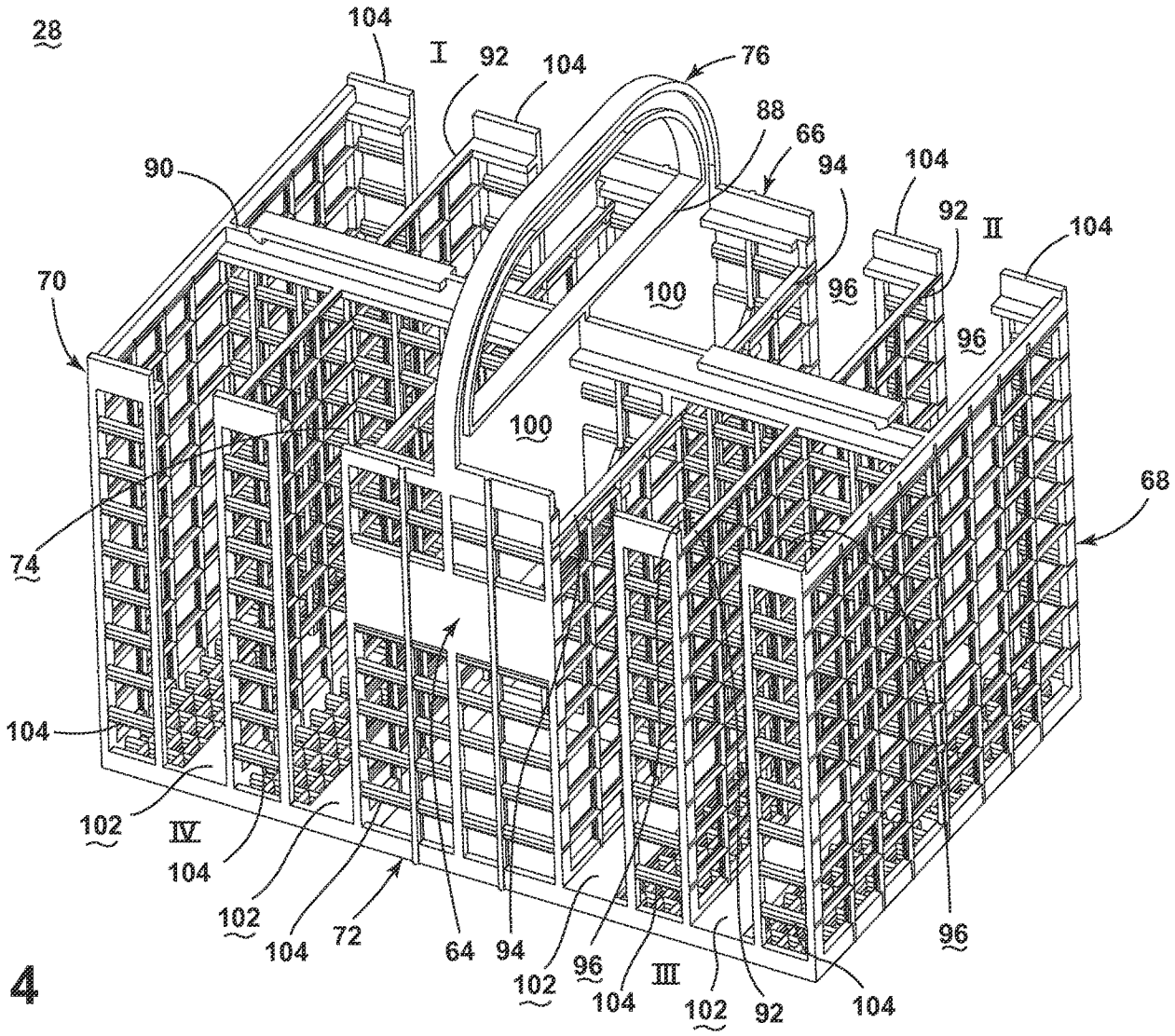
FIG. 4 is a perspective view of a basket body of the utensil basket of FIG. 3.

FIG. 4 is a perspective view of the basket body of the utensil basket 28. The basket 28 can include two primary partitions 88, 90 which divide the basket 28 into the four quadrants I-IV. One primary partition 88 extends between the front and rear walls 64, 66, and can be substantially aligned with the handle 76 to pass through the middle of the basket 28. The other primary partition 90 extends between the opposing side walls 68, 70, and bisects the first primary partition 88.

Each quadrant I-IV further has two secondary partitions 92, 94 which divide the quadrant I-IV into three compartments. The two outermost compartments are utensil storage compartments 96 provided for holding utensils, and the third innermost compartment, closest to the handle 76, is an actuator compartment 100 that accommodates the actuator 86 of the loading/unloading mechanism 80. The secondary partitions 92, 94 are spaced from each other and extend parallel to the first primary partition 88, between one of the opposing front and rear walls 64, 66 and the second primary partition 90.

Each utensil storage compartment 96 has an elongated pocket 102 formed by an opening in a portion of one of the opposing side walls 68, 70 and is open at its upper end as defined by the open top 74 of the basket 28. The pocket 102 forms an egress for utensils during unloading. Adjacent each pocket 102 is a blocker 104 defined by a substantially closed portion of one of the opposing front and rear walls 64, 66. As noted above, the walls defining the storage compartment 96, including the blocker 104 have a plurality of openings such that wash liquid can be flushed through the storage compartment 96. Similarly, the walls defining the actuator compartment 100 are substantially closed, but have a plurality of openings such that wash liquid can be flushed through the actuator compartment 100, save for being open at its upper end as defined by the open top 74 of the basket 28.

Figure 5:
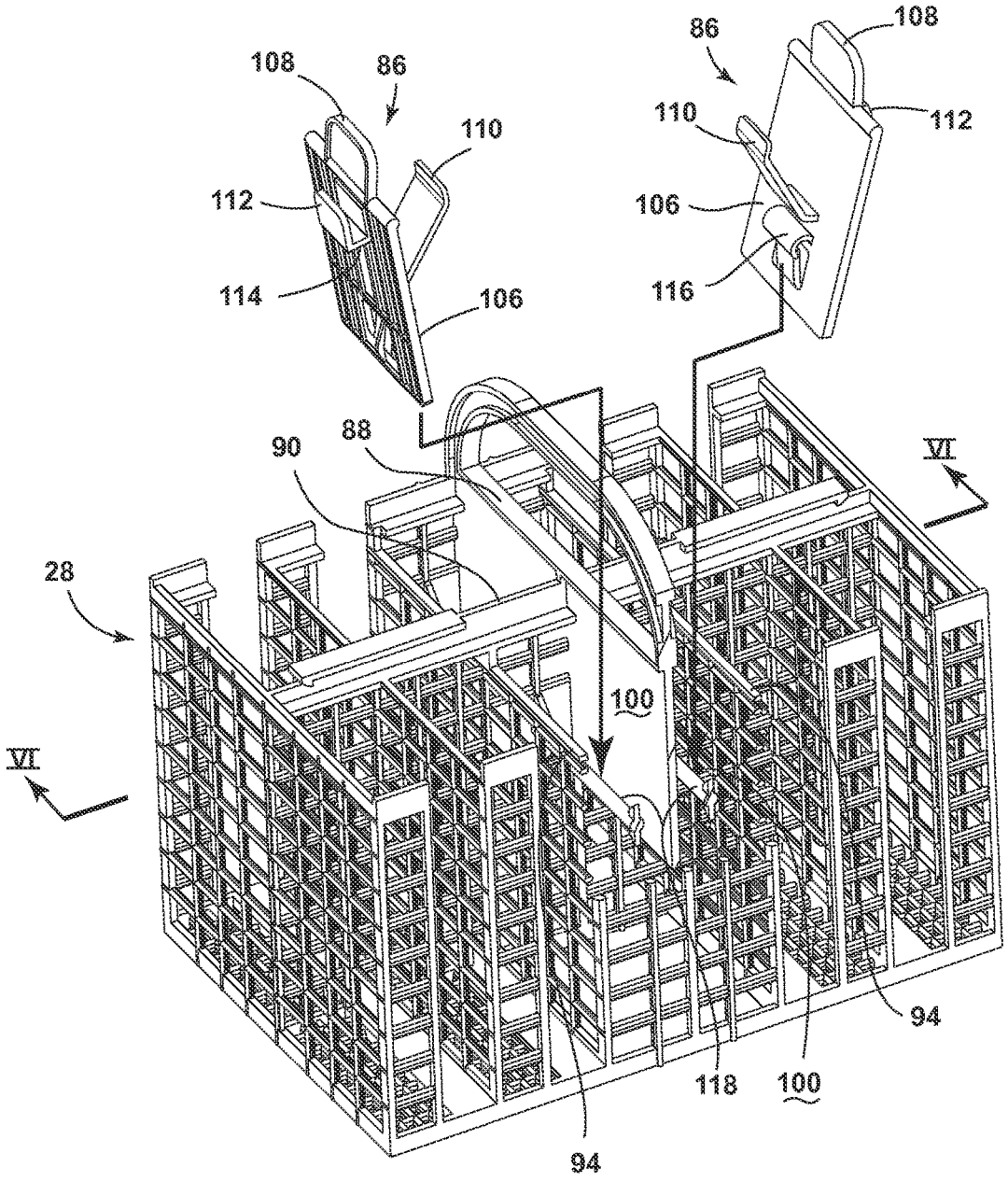
FIG. 5 is an exploded view of a portion of the utensil basket of FIG. 3, showing some of the actuators exploded from the basket.

FIG. 5 is an exploded view of a portion of the utensil basket 28, showing some of the actuators 86 exploded from the basket 28. Each actuator 86 can be a lever 106 which is pivotally coupled with the basket 28 such that movement of the lever in turn slides the mover 84 (FIG. 3) between the loading and unloading position. The lever 106 includes a user-engageable tab 108 that projects at least partially above the walls defining the actuator compartment 100 such that a user can press the tab 108 to move the lever 106. The actuator 86 can further include a biasing member 110 operably coupled with the lever 106 to bias the lever 106 toward the loading position, as described in greater detail below. As shown, the biasing member 110 can be a spring arm projecting from the lever 106.

The actuator 86 can further include a mover coupler 112 which receives a portion of the mover 84 to operably couple the mover 84 to the actuator 86 for movement with the actuator 86, as is described in greater detail below. As illustrated, the mover coupler 112 can be a substantially U-shaped projection 114 on the opposite side of the lever 106 from the biasing member 110 and which is open at an upper end to receive a portion of the mover 84.

Figure 6:
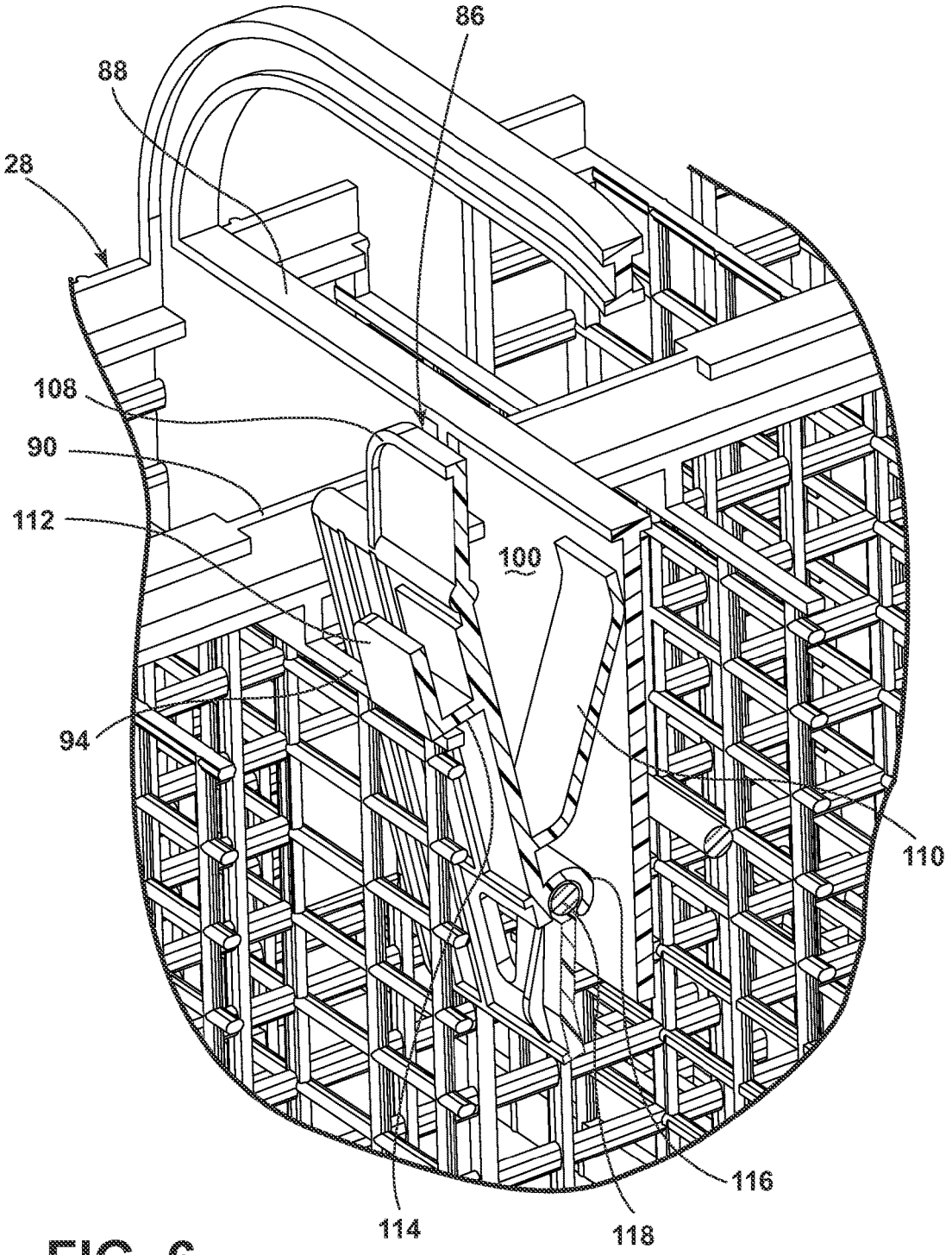
FIG. 6 is a cross-sectional view taken through line VI-VI of FIG. 5, showing the actuator in the assembled position with the basket.

FIG. 6 illustrates the assembly of one of the actuators 86 with the basket 28. The pivot connection between the actuator 86 and the basket 28 is shown herein as including a sleeve 116 provided on the lever 106 and a shaft 118 provided on the basket 28 within the actuator compartment 100. The sleeve 116 snaps onto the shaft 118 to form a hinge connection between the actuator 86 and the basket 28. The biasing member 110 engages the primary partition 88 of the basket 28, and may be under compression when the lever 106 is seated in the actuator compartment 100 in order to force the lever 106 against the secondary partition 94 to a closed position. The mover coupler 112 further rests on or above the secondary partition 94 in the closed position.

Figure 7:
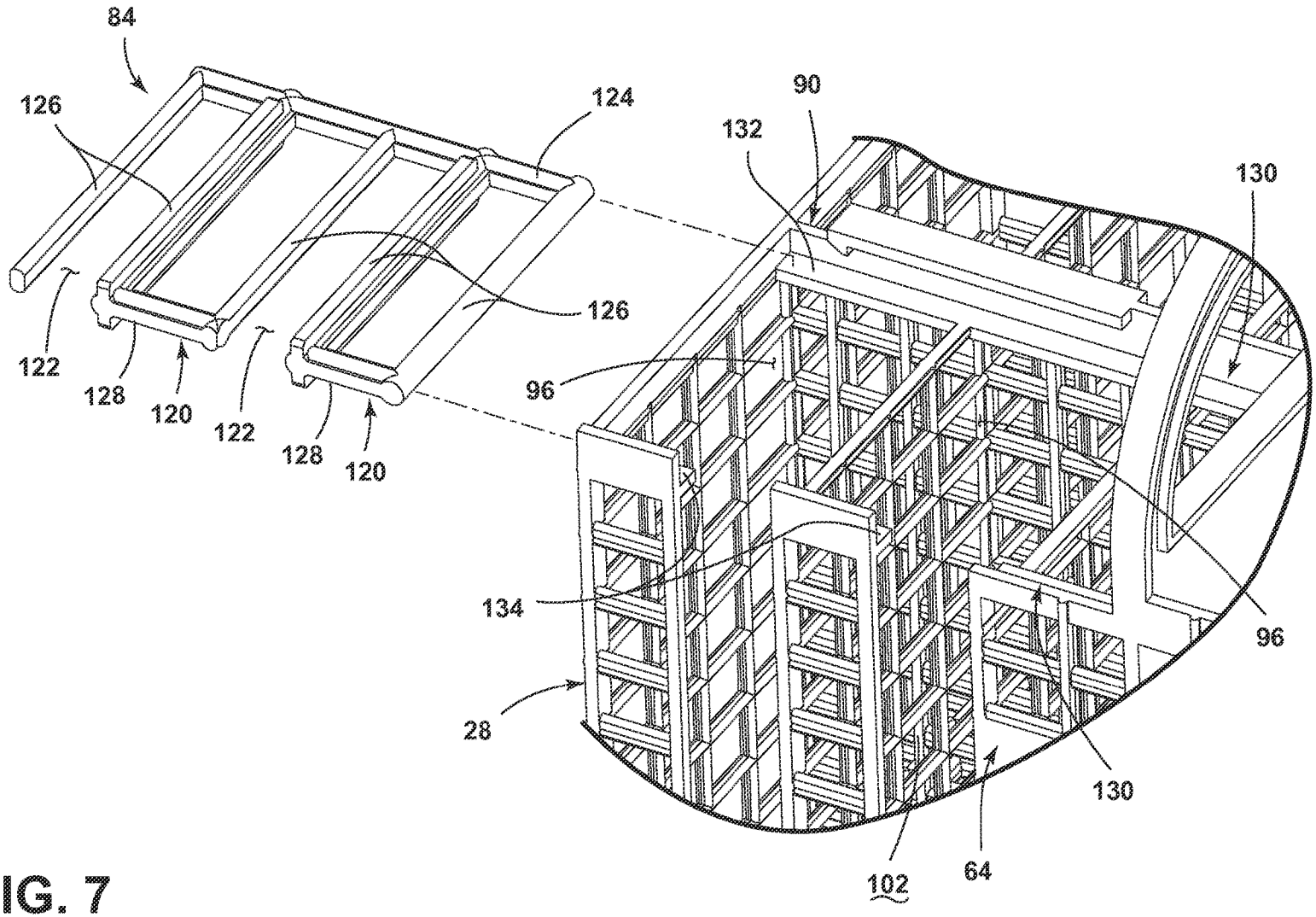
FIG. 7 is an exploded view of a portion of the utensil basket of FIG. 3, showing a utensil mover exploded from the basket.

FIG. 7 is an exploded view of a portion of the utensil basket 28, showing one of the utensil movers 84 exploded from the basket 28. The mover 84 includes sections dedicated to each of the utensil storage compartments 96 of the quadrant, shown here for illustrative purposes as quadrant IV, including a closure 120 for selectively closing the pocket 102 of the storage compartment 96 during loading and during cleaning, and an open carrier 122 for moving utensils in the storage compartment 96 to the pocket 102 during unloading. The sections are operably coupled together, such that motion of the mover 84 slides both of the closures 120 and carriers 122 for the quadrant at the same time.

As shown herein, each mover 84 is provided with an axially slidable shaft 124 with multiple arms 126 extending perpendicularly from the shaft 124. Three arms 126 define the closure 120 and carrier 122 dedicated to each of the utensil storage compartments 96, with the middle arm 126 being shared by the closure 120 and carrier 122 of different compartments 96. To further define the closure 120, two sets of the arms 126 are joined by an end bar 128. The innermost arm 126 further defines an actuator bar that is operably coupled with the actuator 86.

Rails 130 are provided in each quadrant for slidingly supporting the mover 84 at or near the upper edge of the basket 28. The rails 130 can be formed by ledges 132, 134 which extend from the front and rear walls 64, 66 and from the primary partition 90 of the basket 28, and which are recessed below the upper edge of the basket 28. The ledges 132 on the primary partition 90 can be substantially continuous, while the ledges 134 on the front and rear walls 64, 66 can be non-continuous due to the presence of the pockets 102. The overall length of the ledges 132, 134 can be greater than the length of the mover 84 to allow for sliding movement of the mover 84 relative to the rails 130.

Figure 8:
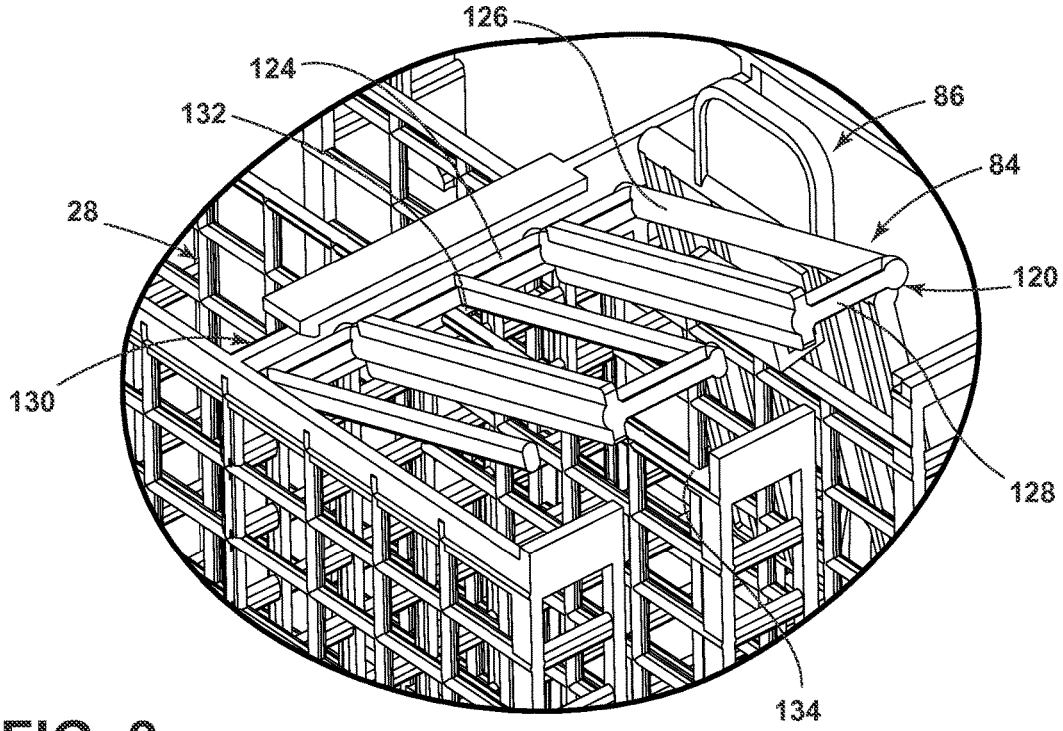
FIGS. 8-9 are views similar to FIG. 7, showing the assembly of the utensil mover with the basket.
Figure 9:
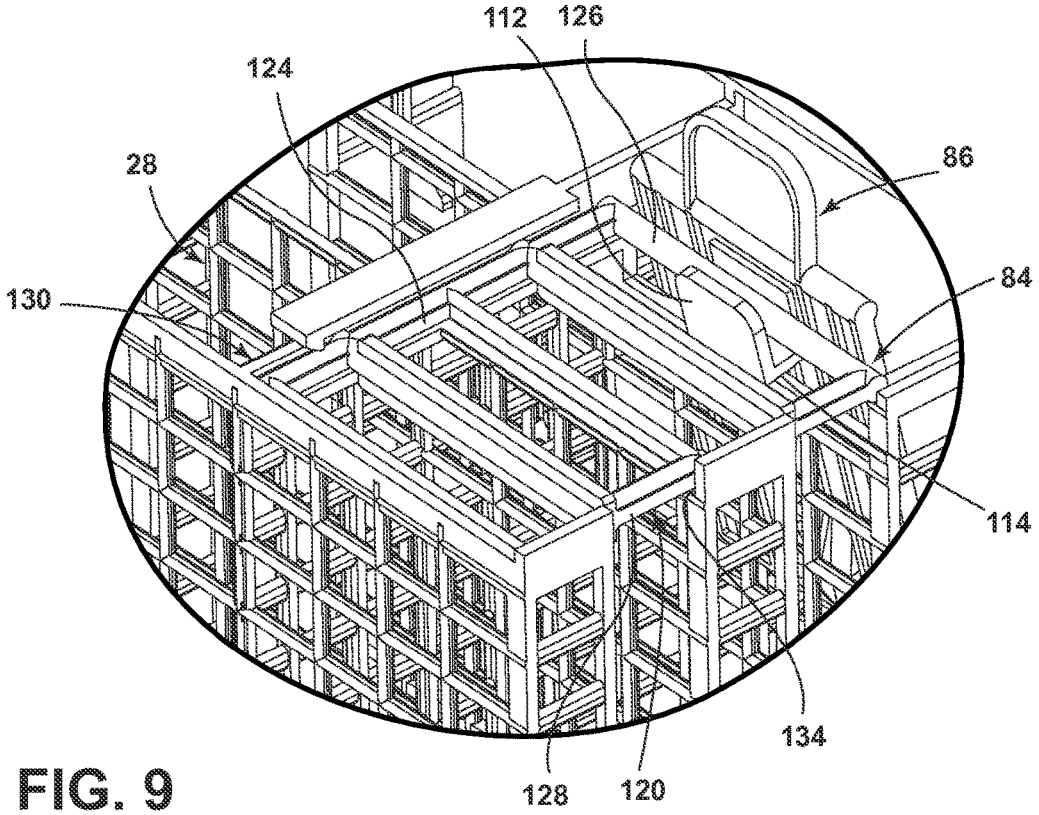

FIGS. 8-9 illustrate the assembly of the mover 84 with the basket 28. The mover 84 can be inserted in the basket 28 at an angle, with the shaft 124 first placed on the partition ledge 132 and the opposite end of the mover 84 thereafter dropped onto the opposing ledge 134. This seats the actuator bar 126 within the U-shaped projection 114 of the actuator 86, which operably couples the motion of the actuator 86 with the mover 84 such that the mover 84 can slide along the rails 130 when the actuator 86 is pivoted.

Figure 10:
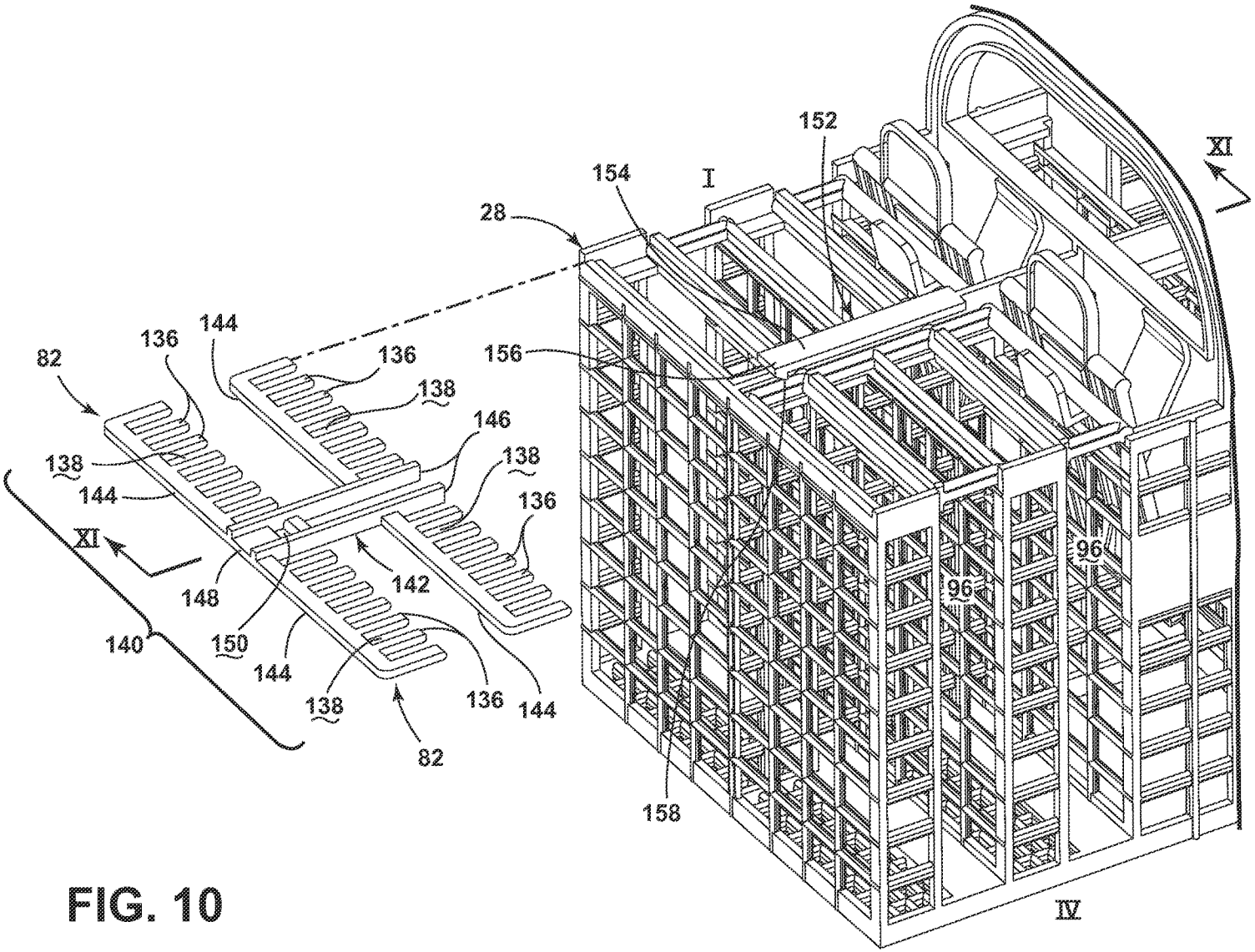
FIG. 10 is an exploded view of a portion of the utensil basket of FIG. 3, showing a loading grid exploded from the basket.

FIG. 10 illustrates one of the loading grids 82 exploded from the basket 28. The loading grid 82 includes multiple dividers 136 which are spaced from each other to define multiple slots 138 configured to receive at least one utensil. The dividers 136 can be provided in the form of tines which define open-ended slots 138. The loading grid 82 can form a partial closure for the utensil storage compartments 96 which effectively closes off a portion of the open top of the utensil storage compartments 96 with the dividers 136, while leaving a portion of the open top open or undivided by the dividers 136 by way of the slots 138.

The slots 138 defined by the dividers 136 may be configured to receive a single utensil. This can provide gaps between adjacent utensils loaded into the grid 82, which may provide better cleaning action to the utensils and may prevent wear caused by utensils rubbing against each other during a cycle of operation. The dimensions of the slots 138 can further be configured to allow the handle of a utensil, but not the utility end, such as the tines in the case of forks or the bowl in the case of spoons, to pass between the dividers 136. This exposes the utility end of the utensil to more of the cleaning action, as the utility end is not obstructed by any portion of the basket 28. In conjunction with this, the height of the utensil storage compartments 96 can be configured so that the utensil is suspended above the bottom of the compartment when loaded into the grid 82. In this configuration, the utensil effectively hangs within the basket 28 by its utility end. It is noted that a single, uniform grid configuration may not suspend all types of utensils. For example, the loading grid 82 can be configured with dividers that will suspend spoons and forks, but not knives.

In order to simplify manufacturing and assembly, the loading grids 82 for multiple quadrants of the basket 28 may be integrally formed with each other. As shown, the loading grids 82 for two quadrants are integrally formed with each other as single grid element 140. Each grid element 140 includes a central support 142 with four branches 144. Each branch 144 forms a common support for multiple dividers 136, which extend transversely from the branch 144. The branches 144 are arranged in two parallel rows, with each row corresponding to one utensil storage compartment 96. The central support 142 can include parallel rails 146 from which the branches 144 extend in opposing directions, and which are connected to each other by a cross-piece 148.

A retaining recess 150 can be formed in the cross-piece 148 and receives a portion of a retainer 152 provided on the basket 28 to retain the loading grid 82 in place on the basket 28. The retainer 152 can be a resilient arm 154 flexibly coupled with the primary partition 90 at one end and having an opposing free angled end 156 having a tab 158.

Figure 11:
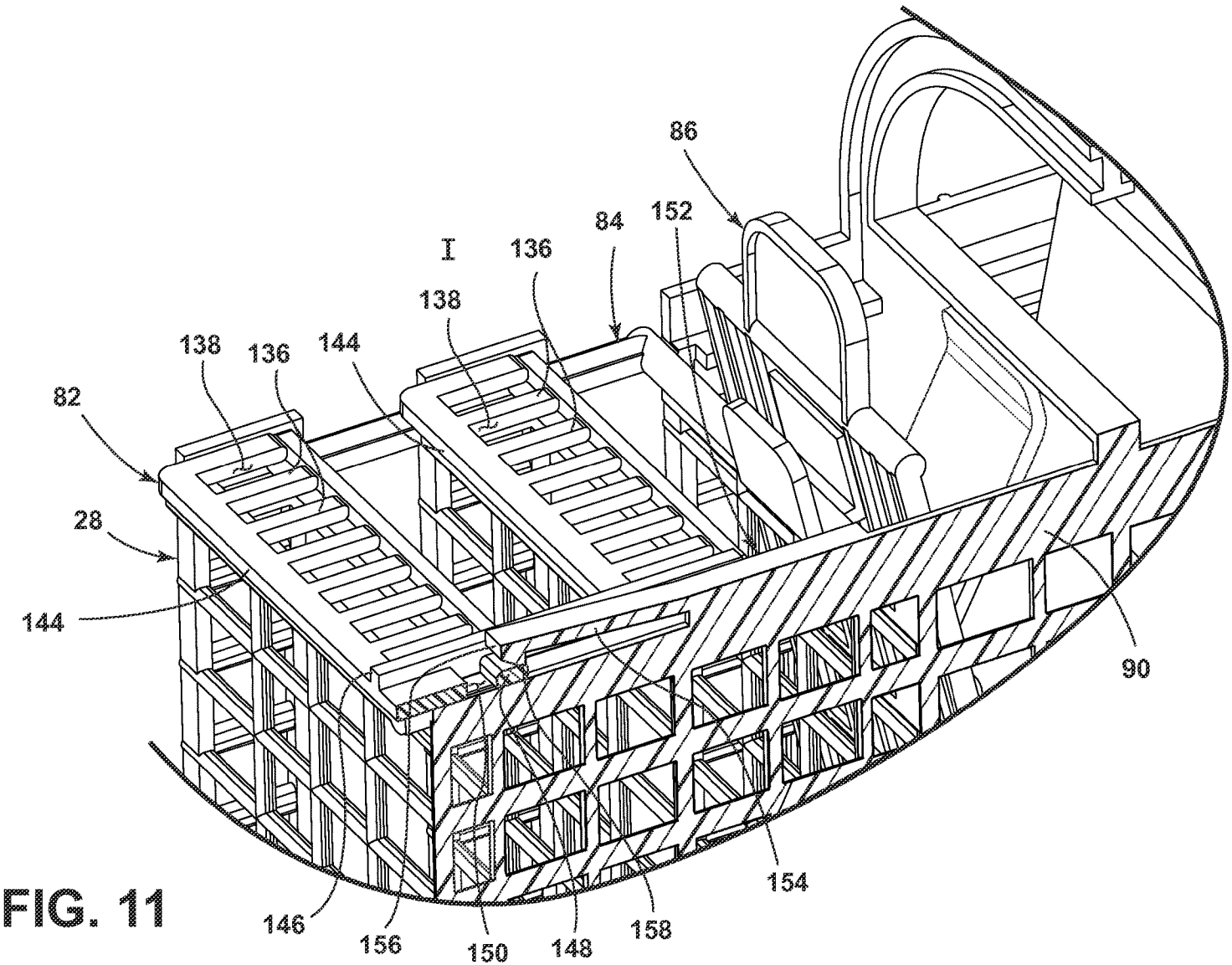
FIGS. 11-12 are close-up, cross-sectional views taken through line XI-XI of FIG. 10, showing the assembly of the loading grid with the basket.
Figure 12:
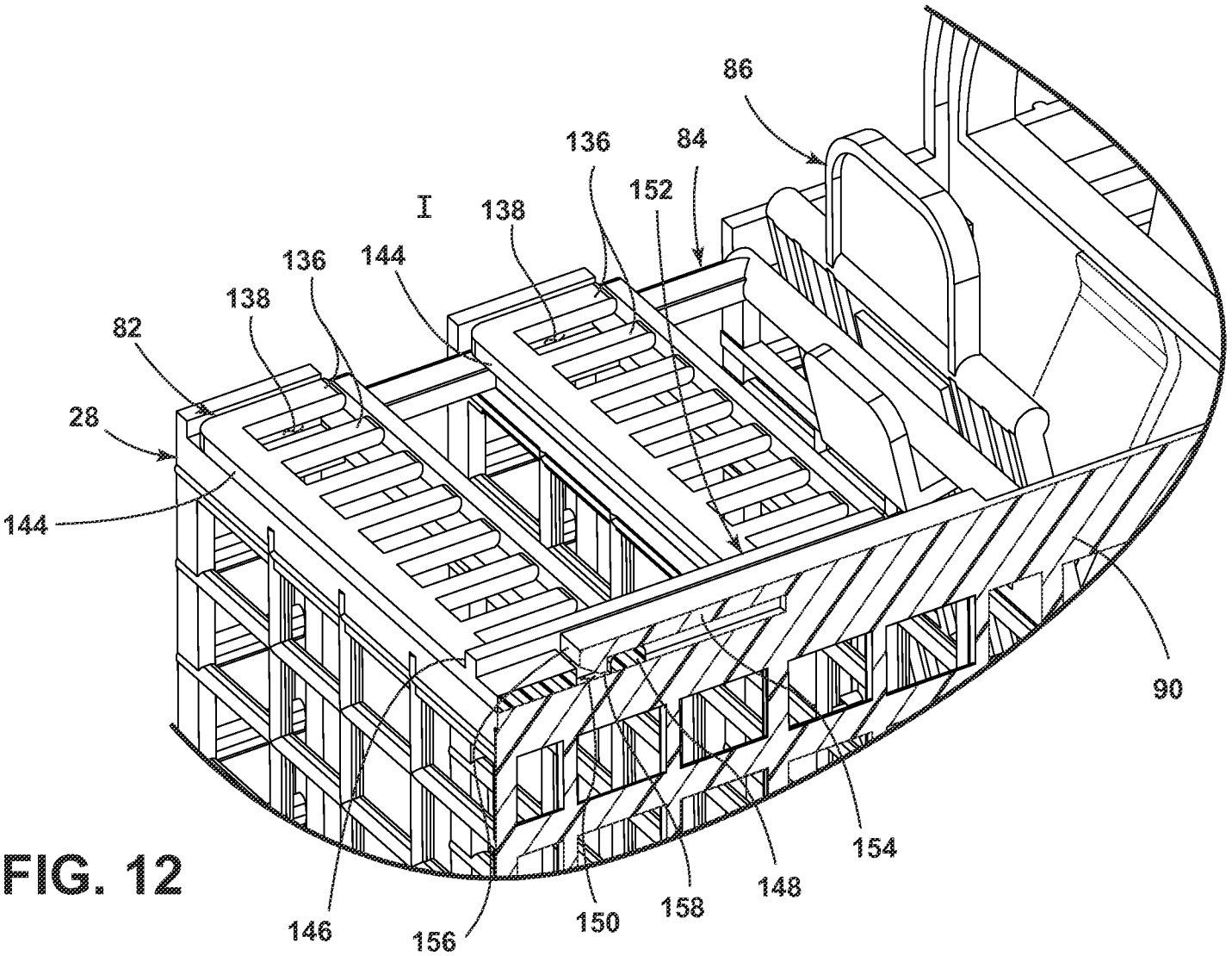

FIGS. 11-12 are close-up, cross-sectional views taken through line XI-XI of FIG. 10, showing the assembly of the loading grid 82 with the basket 28. The grid element 140 is aligned with the two quadrants and slid along the top of the mover 84, with the rails 146 sliding on either side of the retainer 152. When the retainer 152 encounters the cross-piece 148, the angled end 156 forces the resilient arm 154 up and over the cross-piece 148. As the grid element 140 is slid further onto the mover 84, the resilient arm 154 snaps back into place with the tab 158 received in the retaining recess 150.

Figure 13:
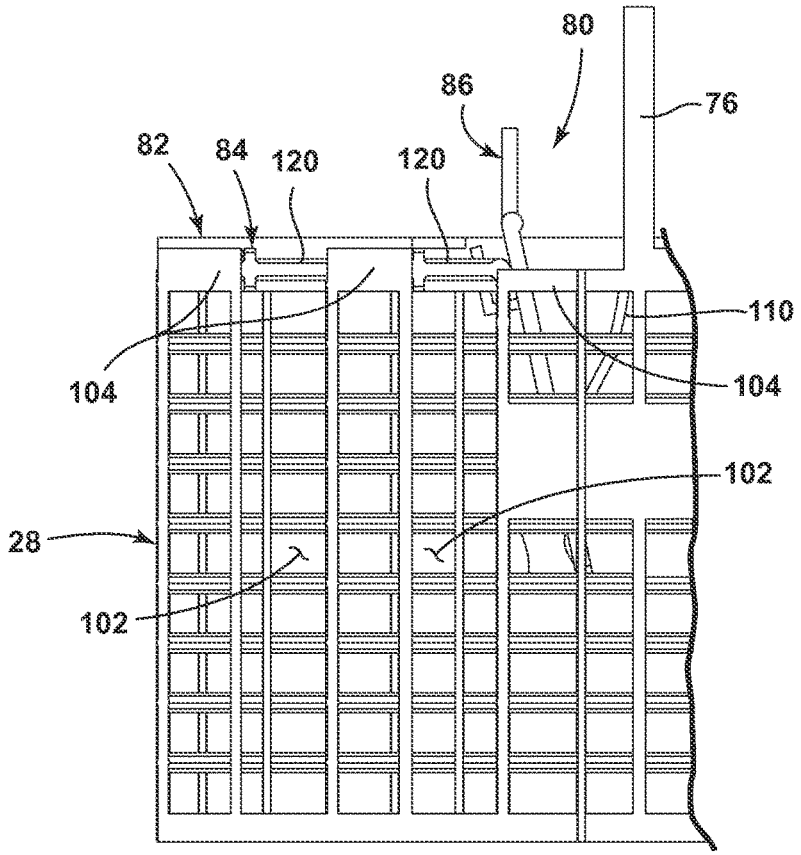
FIG. 13 is a side view of a portion of the utensil basket, showing the loading/unloading mechanism in a closed position.
Figure 14:
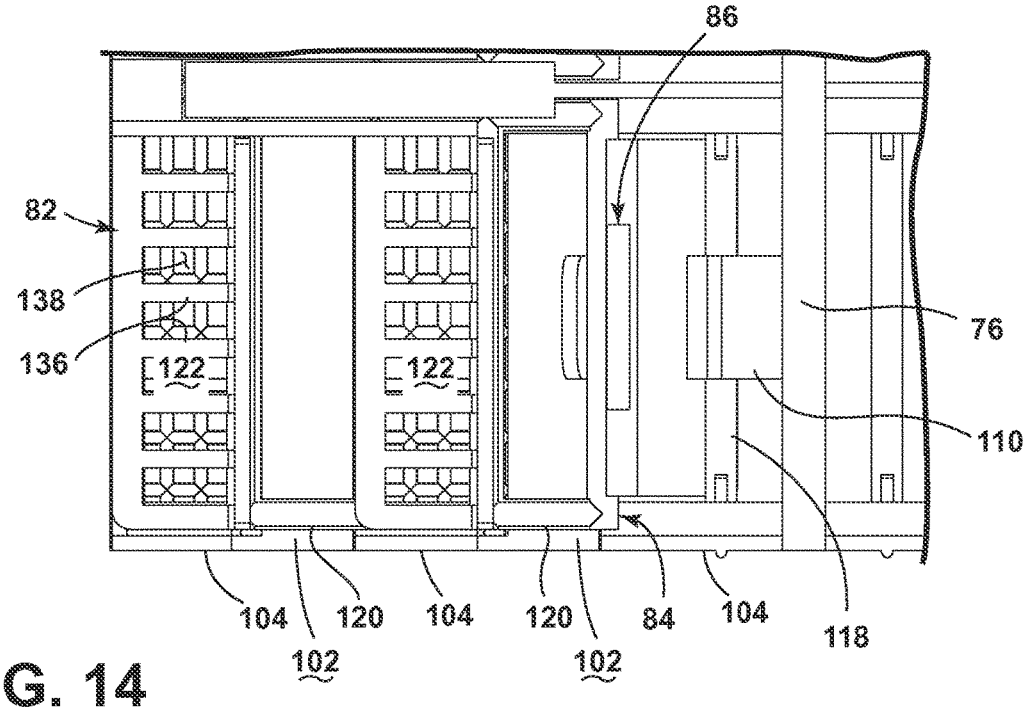
FIG. 14 is a top view of FIG. 13.
Figure 15:
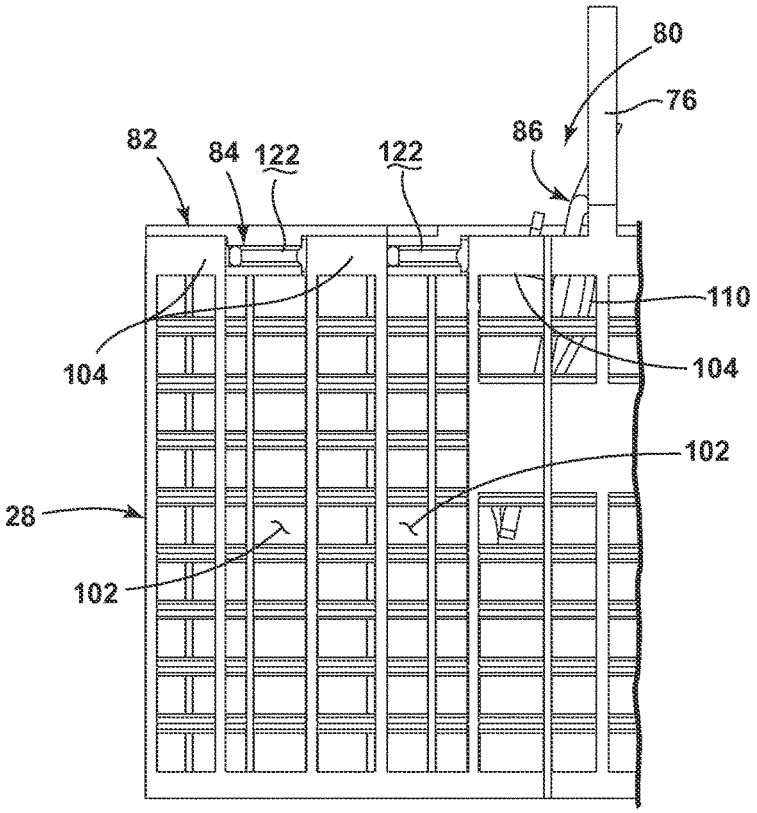
FIG. 15 is a side view of a portion of the utensil basket, showing the loading/unloading mechanism in an open position.
Figure 16:
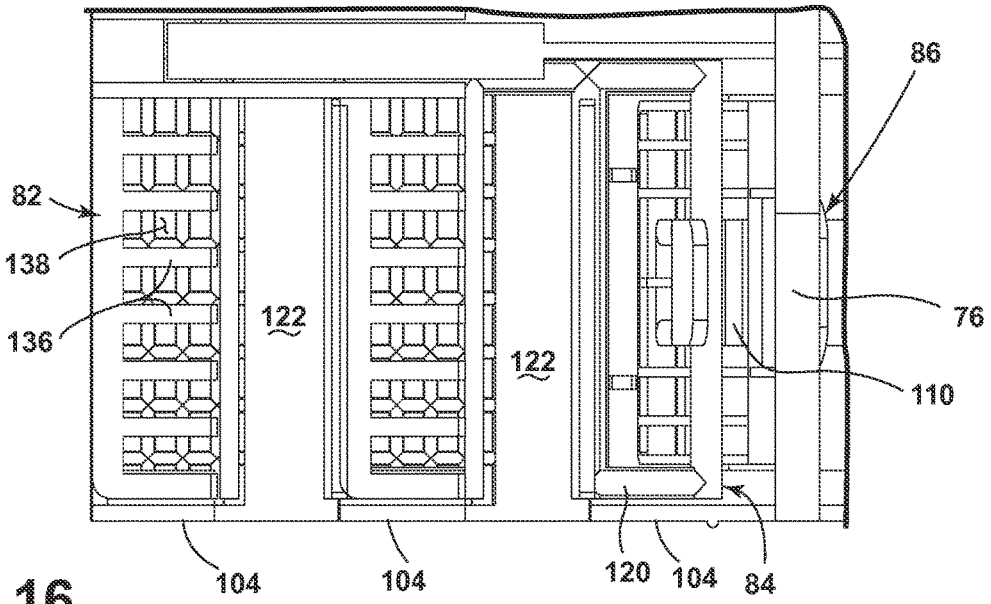
FIG. 16 is a top view of FIG. 15.

Operation of the loading/unloading mechanism 80 for the basket 28 is illustrated with respect to FIGS. 13-16. FIGS. 13-14 are side and top views of a portion of the utensil basket 28, showing the loading/unloading mechanism 80 in a closed position. FIGS. 15-16 are side and top views of a portion of the utensil basket 28, showing the loading/unloading mechanism 80 in an open position.

With reference to FIGS. 13-14, in the closed position, the actuator 86 is biased away from the basket handle 76 by the biasing member 110, which in turn pushes the mover 84 away from the basket handle 76. The carriers 122 of the mover 84 are located substantially beneath the dividers 136 of the loading grid 82, such that utensils loaded into the slots 138 are held within the carriers 122 and behind the blocker 104 of the utensil storage compartments 96. The closures 120 of the mover 84 are located substantially at the pockets 102 of the utensil storage compartments 96.

As noted above, the actuator 86 may be under a compressive force in the closed position in order to create a positive loading force on the mover 84 which can improve wash performance by maintaining the utensils in more or less the same position throughout the cycle of operation. Without the positive loading force, the utensils may shift around during cleaning.

With reference to FIGS. 15-16, in the open position, the actuator 86 is pressed toward the basket handle 76, which in turn pulls the mover 84 toward the basket handle 76. Utensils held within the carriers 122 of the mover 84 are likewise pulled out of the loading grid and into the pockets 102. The closures 120 of the mover 84 are located substantially behind two of the blockers 104 of the utensil storage compartments 96 so as to be out of the way of the pockets 102.

Figure 17:
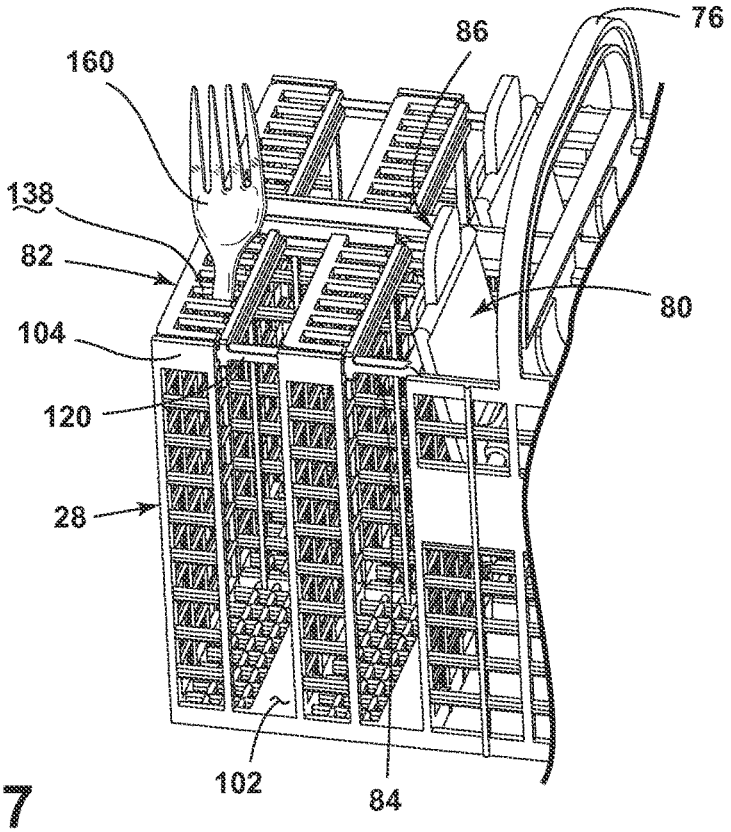
FIG. 17 is a perspective view of the utensil basket loaded with a utensil, showing the loading/unloading mechanism in a closed position.
Figure 18:
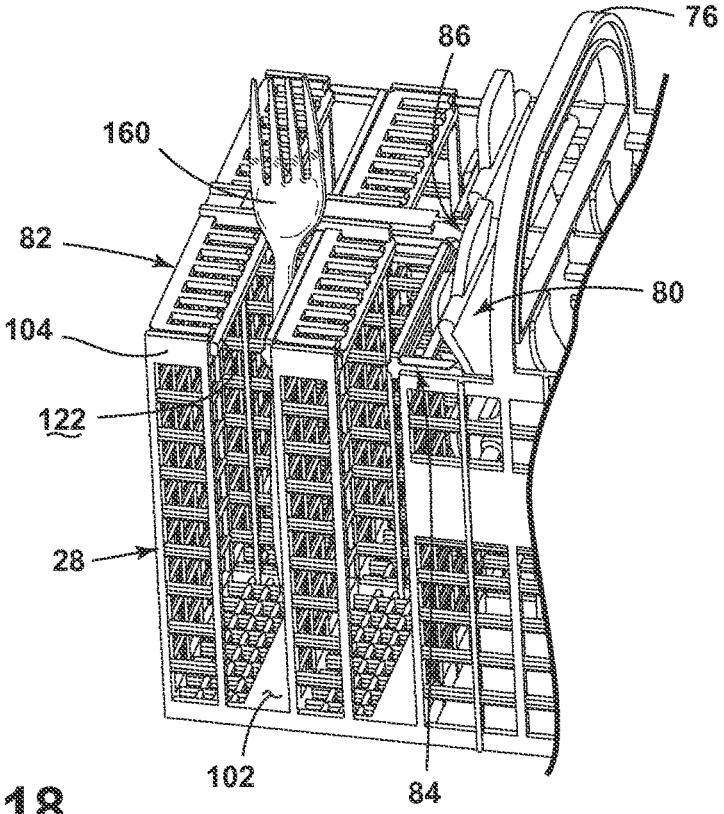
FIG. 18 is a perspective view similar to FIG. 17, showing the loading/unloading mechanism in an open position.

FIGS. 17-18 illustrate the operation of the loading/unloading mechanism 80 for the basket 28 for an example utensil, shown herein as a fork 160. It is understood that the operation proceeds in a similar manner for other types of utensils and for multiple utensils. FIG. 17 shows the loading/unloading mechanism 80 in a closed position in which the fork 160 is held in the loading grid 82, and FIG. 18 shows the loading/unloading mechanism 80 in an open position in which the fork 160 can be unloaded from the basket 28. To load the basket 28, the fork 160 is inserted into a slot 138 of the loading grid 82, with the utility end pointing upwardly. Additional utensils may also be loaded into the basket 28 in a similar manner. After a cycle of operation has been run, a user can remove the basket 28 from the dishwasher 10 (FIG. 1) using the handle 76. The user can open one of the quadrants, shown herein for illustrative purposes as quadrant IV, by gripping the handle 76 in one hand and squeezing the actuator 86 toward the handle 76 using a thumb or finger of the same hand. Without having to contact the utility end of the fork 160, the user can reach into the pocket 102 to remove the fork 160 by its handle, or else tilt the basket 28 to dump the fork 160 out of the basket 28 and onto another surface, such as a countertop, drawer, or tray. Release of the actuator 86 automatically moves the loading/unloading mechanism 80 back to the closed position, automatically readying the quadrant for loading once again.

The loading/unloading mechanism 80 described herein can be applied to utensil baskets other than the basket 28 illustrated herein. For example, the loading/unloading mechanism 80 can be applied to baskets having any number of storage zones for utensils, including a single storage zone. Also, while each loading/unloading mechanism 80 is applied to a storage zone having two separate utensil storage compartments, the loading/unloading mechanism 80 can instead be applied to storage zones having any number of utensil storage compartments, including a single utensil storage compartment. The loading grid 82 and utensil mover 84 can easily be modified to accommodate the number of utensil storage compartments, such as by eliminating or adding closures 120, carriers 122, and dividers 136. Furthermore, for utensils that do not fit in the slots 138, the loading grids 82 on one side of the basket 28 may be removed, and utensils loaded into the carriers 120 of the utensil mover 84 alone.

Figure 19:
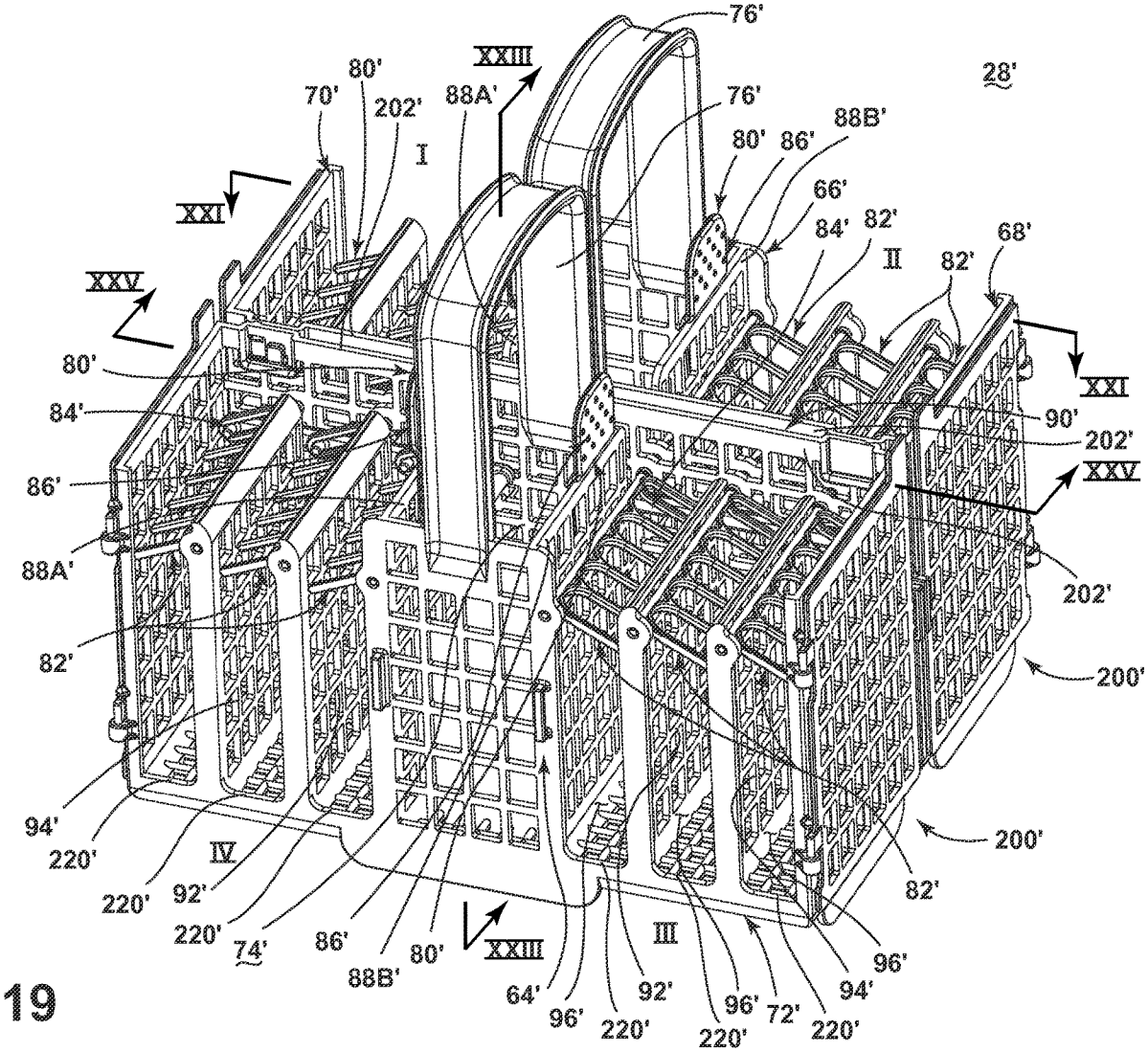
FIG. 19 is a perspective view of a utensil basket having a loading/unloading mechanism according to another embodiment.

An alternative embodiment utensil basket 28' is illustrated in the perspective view of FIG. 19. Elements of the alternative embodiment are identified with a reference numeral bearing a prime symbol ('), and the elements similar to those of the previous embodiment of FIGS. 3-18 are identified with the same reference numeral used in the description of the previous embodiment with the addition of the prime symbol ('). The basket 28' includes a front wall 64' and a rear wall 66' joined by opposing side walls 68', 70' and a bottom wall 72' to define a container having an open top 74'. The walls can be made from a molded plastic generally having an open latticework including a plurality of openings such that wash liquid can enter the basket 28' and contact utensils in the basket 28'.

The basket 28' is provided with a plurality of interior partitions that define a plurality of storage zones for separating utensils during a cycle of operation and for organized loading and unloading of utensils in the basket 28'. The illustrated basket 28' is divided into portions, such as quadrants I-IV, with each quadrant I-IV defining a storage zone for utensils. Each quadrant I-IV has a loading/unloading mechanism 80' for easy and organized loading and unloading of the utensil basket 28'. The loading/unloading mechanism 80' includes a loading grid 82' for loading utensils in an organized manner, a grid mover 84' for moving the loading grid 82' between a forced loading position in which the utensils can be loaded into the loading grid 82' and an unloading position in which the utensils can be removed from the basket 28', and an actuator 86' for moving the grid mover 84' between the forced loading and unloading positions.

The basket 28' can include primary partitions 88A', 88B', 90' that divide the basket 28' into the four quadrants I-IV. Two first primary partitions 88A', 88B' extend between the front and rear walls 64', 66' in a spaced, parallel arrangement near the center of the basket 28'. The second primary partition 90' extends between the opposing side walls 68', 70' and bisects the first primary partitions 88A', 88B'. Moreover, the basket 28' is formed by two substantially identical half baskets 200', each having an inside wall 202' extending between the side walls 68', 70' and parallel to front and rear walls 64', 66', and, when the half baskets 200' are assembled, the inside walls 202' together form the partition 90'. In this condition, the inside walls 202' are positioned adjacent and parallel to one another with a small spacing between the inside walls 202'. Thus, the side walls 68', 70' and the primary partitions 88A', 88B' have a discontinuity at the partition 90', with each of the walls 68', 70' and the partitions 88A', 88B' terminating at the respective inside wall 202'. A handle 76' extends upwardly from the open top 74' of each of the half baskets 200' between the first primary partitions 88A', 88B' and is shown here as spanning the width the half basket 200' between one of the front and rear walls 64', 66' and the respective inside wall 202'. The handles 76' facilitate removal of the basket 28' from the dishwasher 10'.

Figure 20:
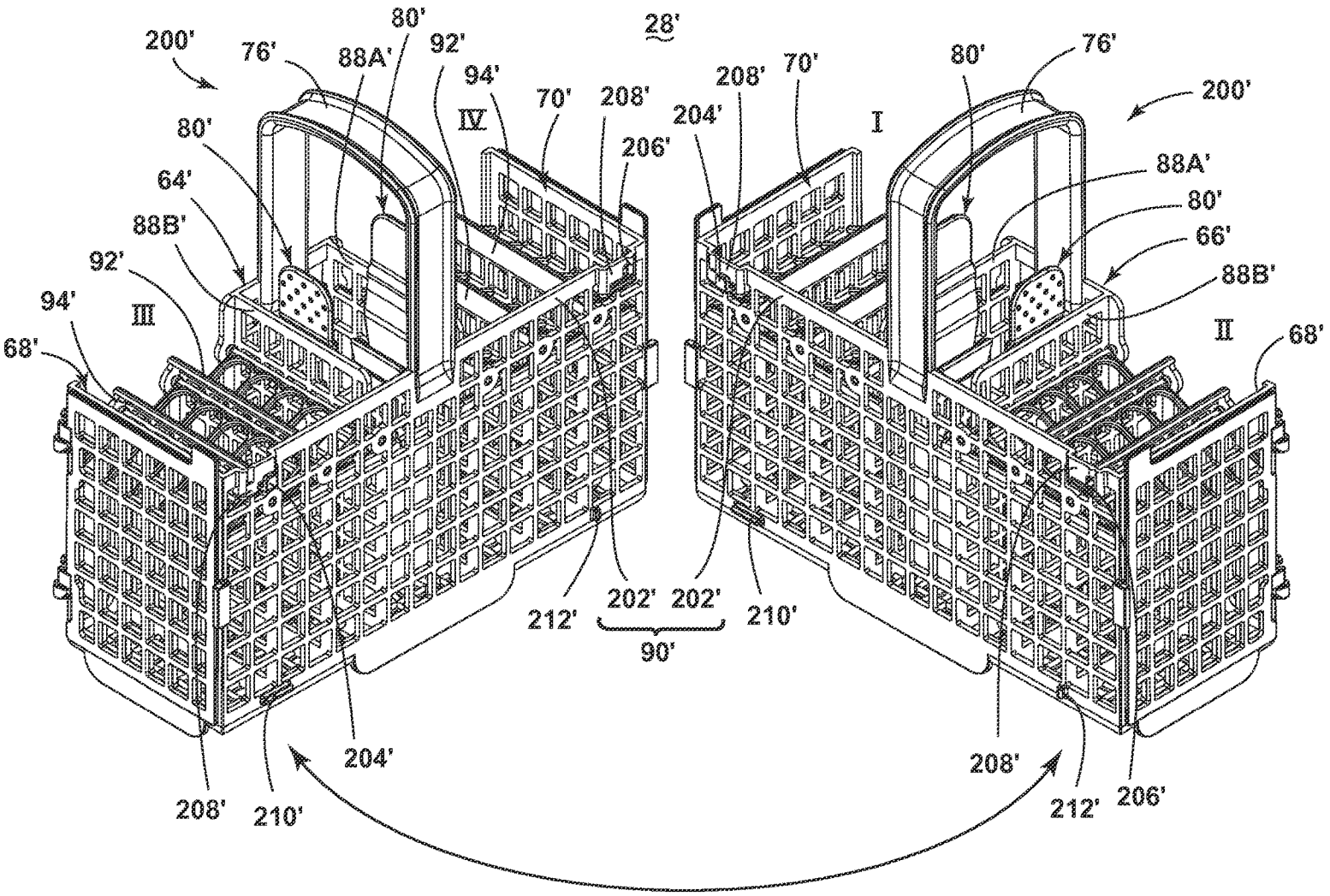
FIG. 20 is a perspective view of the utensil basket of FIG. 19 with two half-baskets shown separated from each other.

The perspective view of FIG. 20 illustrates the half baskets 200' separated to better show structure that holds the half baskets 200' together when coupled. The illustrated coupling structure includes mating tabs 204' and slots 206' formed in protuberances 208' positioned near an upper edge of the inside wall 202' of each of the half baskets 200'. For assembly, the slots 206' receive the tabs 204' at one end of the slots 206' having an opening sized to receive the tabs 204', and the half baskets 200' are slid relative to one other such that the tabs 204' slide within the slots 206' to the other end of the slots 206' that is sized to prevent removal of the tabs 204' therefrom. The protuberances 208' space the inside walls 202' from one another at the upper ends of the inside walls 202', and projections 210', 212' located near the lower edges of the inside walls 202' maintain a similar spacing at the lower ends of the inside walls 202'. It can also be seen in FIG. 20 that the inside wall 202' functions as a rear wall (for the half basket 200' that forms the front wall 64' for the quadrant basket 28') or a front wall (for the half basket 200' that forms the rear wall 66' for the quadrant basket 28') when the half baskets 200' are separated.

Referring again to FIG. 19, each quadrant I-IV further has two secondary partitions 92', 94' that divide the quadrant I-IV into three utensil storage compartments 96' provided for holding utensils. The secondary partitions 92', 94' are spaced from each other in an arrangement between and parallel to one of the first primary partitions 88A', 88B' and one of the opposing side walls 68', 70', depending on the particular quadrant. Further, the secondary partitions 92', 94' extend from one of the front and rear walls 64', 66' to the respective inside wall 202' forming part of the second primary partition 90'. Each utensil storage compartment 96' has a side opening 220' formed in one of the front and rear walls 64', 66' and open at its upper end as defined by the open top 74' of the basket 28'. As noted above, the walls defining the storage compartment 96' have a plurality of openings such that wash liquid can be flushed through the storage compartment 96'.

Figure 21:
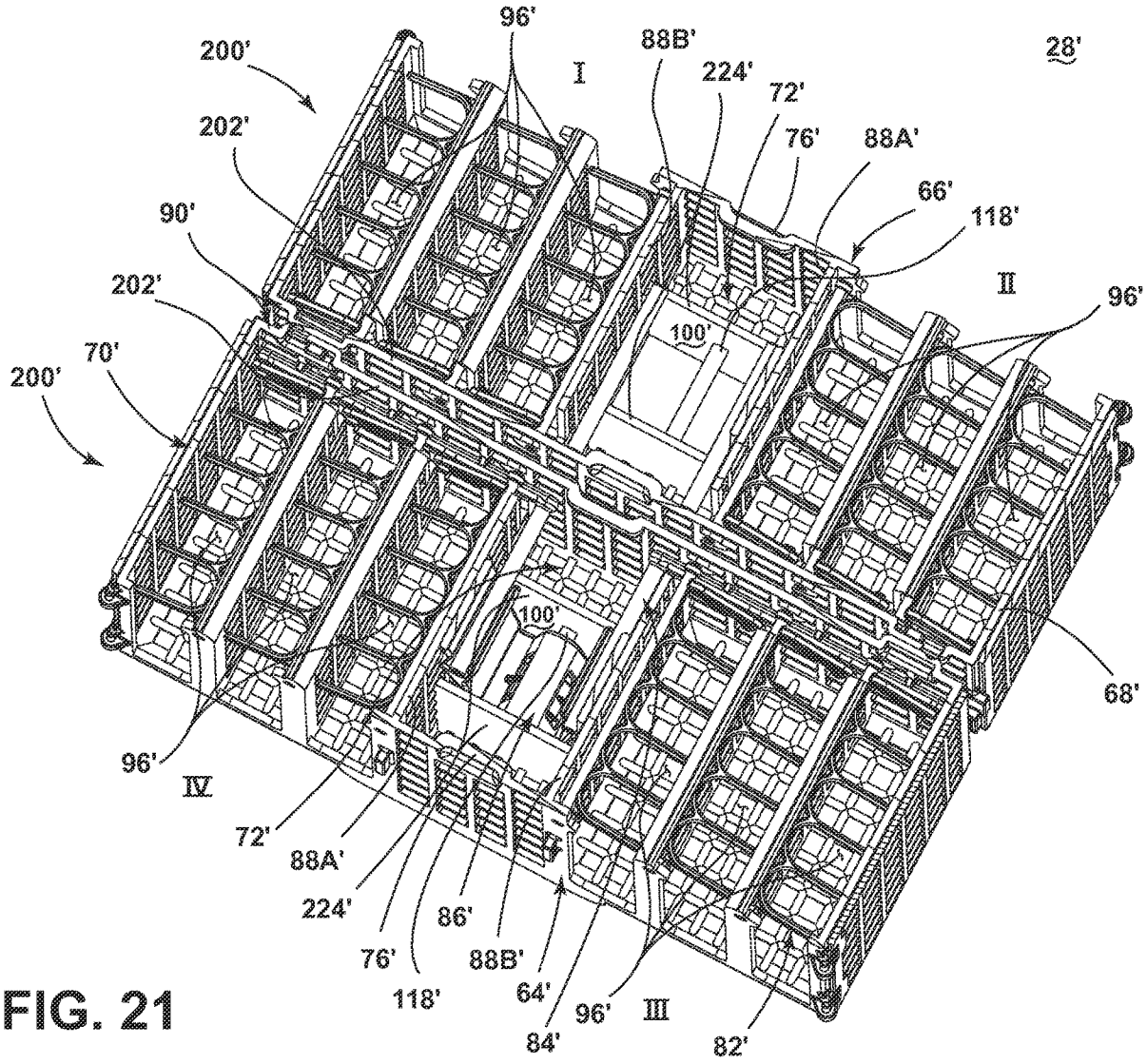
FIG. 21 is a cross-sectional view taken through line XXI-XXI of FIG. 19.

Referring now to FIG. 21, which is essentially a perspective view of the basket 28' from above with the handle 76' sectioned away, the first primary partitions 88A', 88B' in each of the half baskets 200' further define, below the handle 76' and between the partitions 88A', 88B', an actuator compartment 100' that accommodates the actuator 86' of the unloading/loading mechanism 80'. The actuator 86' is removed from one of the actuator compartments 100' for better viewing the interior of the actuator compartment 100'. Within the actuator compartment 100', a hinge shaft 118' extends between a pair of support walls 224' positioned transverse to the partitions 88A', 88B' such that the hinge shaft 118' is parallel to the partitions 88A', 88B'. The hinge shaft 118' provides a hinge support for the actuator 86' (not shown in FIG. 21), as will be described in more detail below. The support walls 224' can be completely closed, as illustrated by example, while the walls defining the actuator compartment 100', as with the secondary partitions 92', 94', are substantially closed but have a plurality of openings such that wash liquid can be flushed through the actuator compartment 100', save for being open at its upper end as defined by the open top 74' of the basket 28'. Additionally, the bottom wall 72' may be completely open beneath at least a portion of the actuator compartment 100'; a lattice structure is not necessary here because the bottom wall 72' does not support any utensils or other objects.

Figure 22:
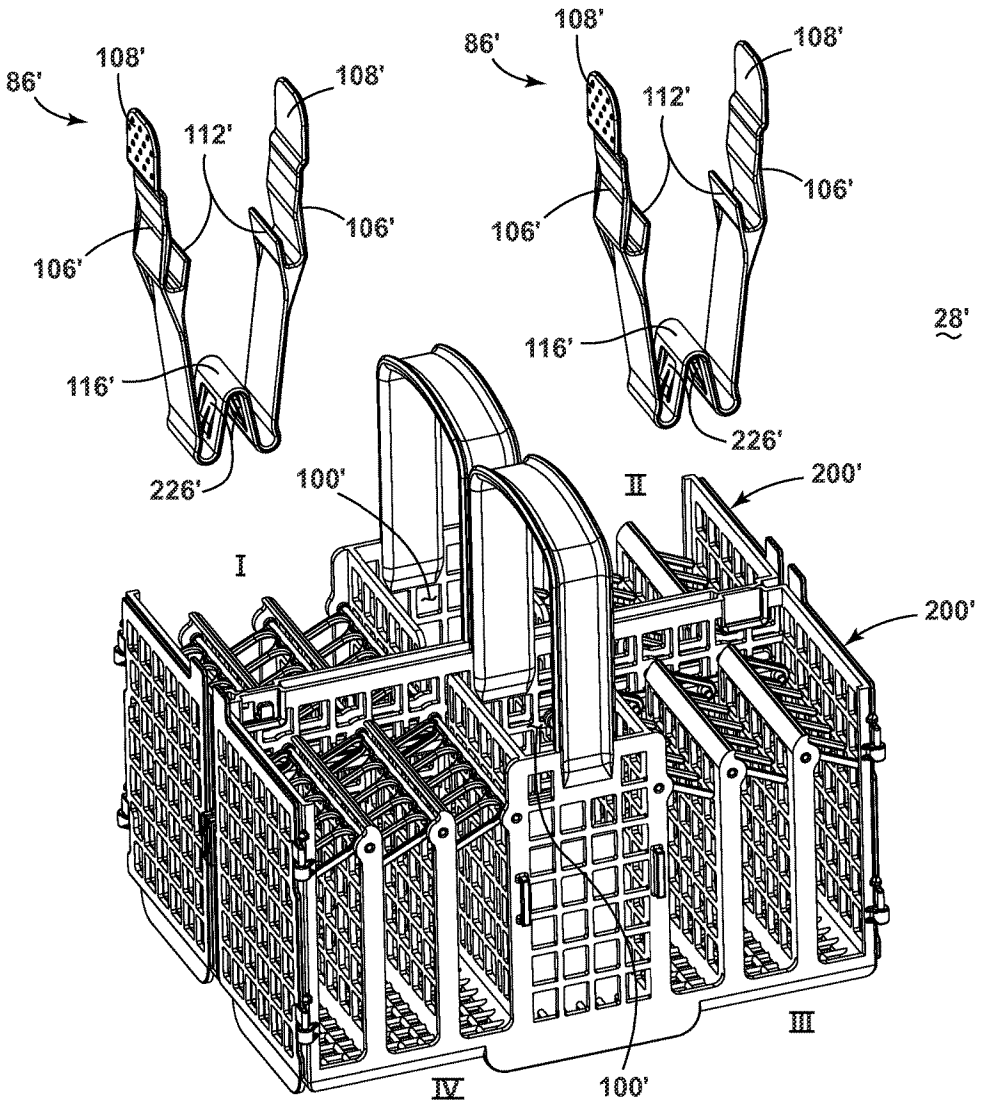
FIG. 22 is a perspective view of the utensil basket of FIG. 19, showing actuators of the loading/unloading mechanism exploded from the basket.

FIG. 22 is a perspective view of the utensil basket 28', showing the actuators 86' exploded from the basket 28'. Each actuator 86' can include two levers 106' joined to each other at their lower ends. Each lever 106' corresponds to one of the four quadrants I-IV such that each actuator 86' corresponds to the two quadrants I and II or III and IV of each half basket 200'. In the present embodiment, each lever 106' includes a user-engageable tab 108' that projects at least partially above the walls defining the actuator compartment 100' (FIG. 19) such that a user can press the tab 108' to move the lever 106'. The levers 106' are joined to each other at their lower ends by a generally upside down V-shaped portion forming a sleeve 116' at its apex and a pair of detents 226' on the walls adjacent the sleeve 116'. One of the levers 106' of the actuator 86' functions as a biasing member, similar to a spring arm, for the other, connected lever 106' of the actuator 86' to bias the lever 106' toward the loading position, as described in greater detail below. The actuator 86' can further include a mover coupler 112' that receives a portion of the mover 84' (FIG. 23) to operably couple the mover 84' to the actuator 86' for movement with the actuator 86', as is described in greater detail below. As illustrated, the mover coupler 112' can be a substantially U-shaped projection located on the side of the lever 106' that faces the other, connected lever 106' and open at an upper end to receive a portion of the mover 84'.

Figure 23:
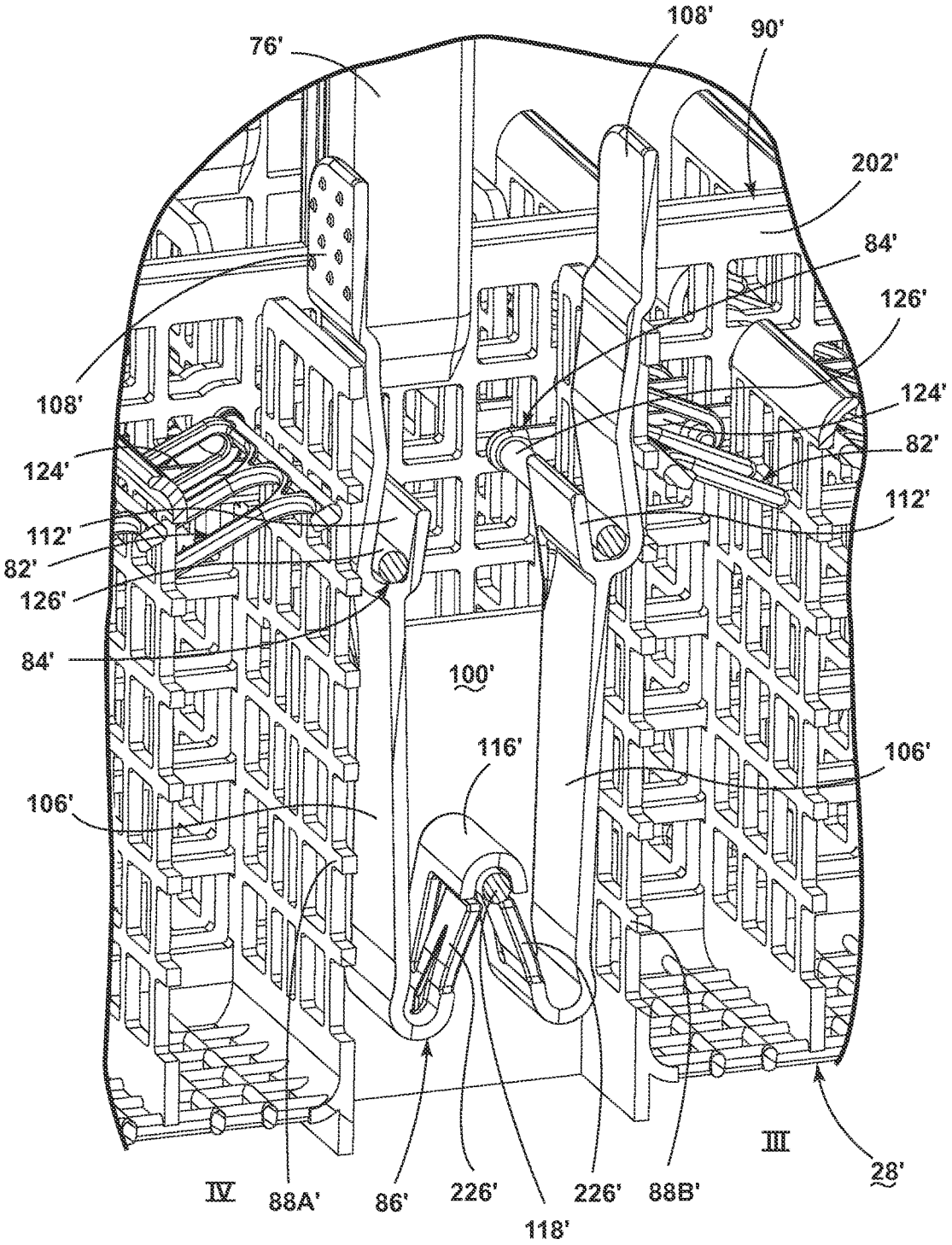
FIG. 23 is a close-up, cross-sectional view taken through line XXIII-XXIII of FIG. 19, showing the actuator in the assembled position in the basket.

FIG. 23 illustrates the assembled position of one of the actuators 86' in the basket 28'. The actuator 86' is pivotally coupled with the basket 28', with the pivot connection between the actuator 86' and the basket 28' shown herein as including the sleeve 116' provided at the lower ends of the levers 106' and the shaft 118' provided on the basket 28' within the actuator compartment 100'. For assembly, the actuator 86' is inserted into the actuator compartment 100' from above. The sleeve 116' snaps onto the shaft 118' to form a hinge or pivot connection between the actuator 86' and the basket 28'. The detents 226' retain the shaft 118' in the sleeve 116'. The levers 106' engage the respective primary partitions 88A', 88B' of the basket 28' in a pre-stressed condition when the actuator 86' is seated in the actuator compartment 100' in order to force the opposing lever 106' against the respective partition 88A', 88B' to a closed position. The mover coupler 112' receives the mover 84' such that pivoting movement of the lever 106' in turn slides the corresponding mover 84' between the loading and unloading positions, as will be described in greater detail below.

Figure 24:
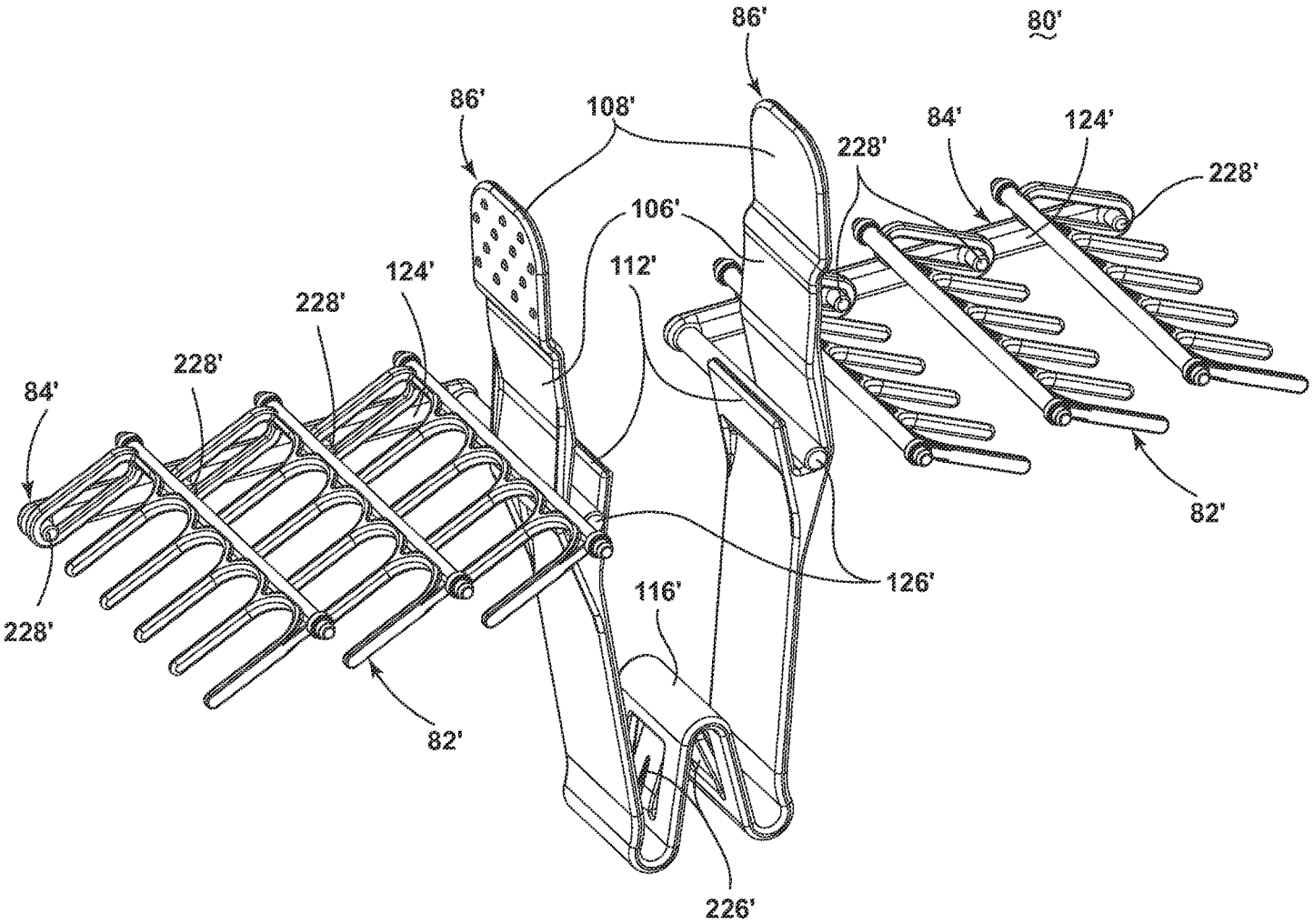
FIG. 24 is a perspective view of the loading/unloading mechanism from the basket of FIG. 19.

FIG. 24 is a perspective view of the unloading/loading mechanism 80' for one of the half baskets 200' (FIG. 20) of the utensil basket 28' and, thus, includes two of the movers 84', one for each quadrant defined within the half basket 200'. The mover 84' is provided with an axially slidable shaft 124' with an arm 126' extending perpendicularly from one end of the shaft 124' to define an actuator bar that is operably coupled with the actuator 86'. Three pins 228' also extend perpendicularly from the shaft 124' in a linearly spaced configuration, with each pin 228' dedicated to one of the utensil storage compartments 96' (FIG. 19) and operably coupled with the loading grid 82' for the corresponding storage compartment 96'.

Figure 25:
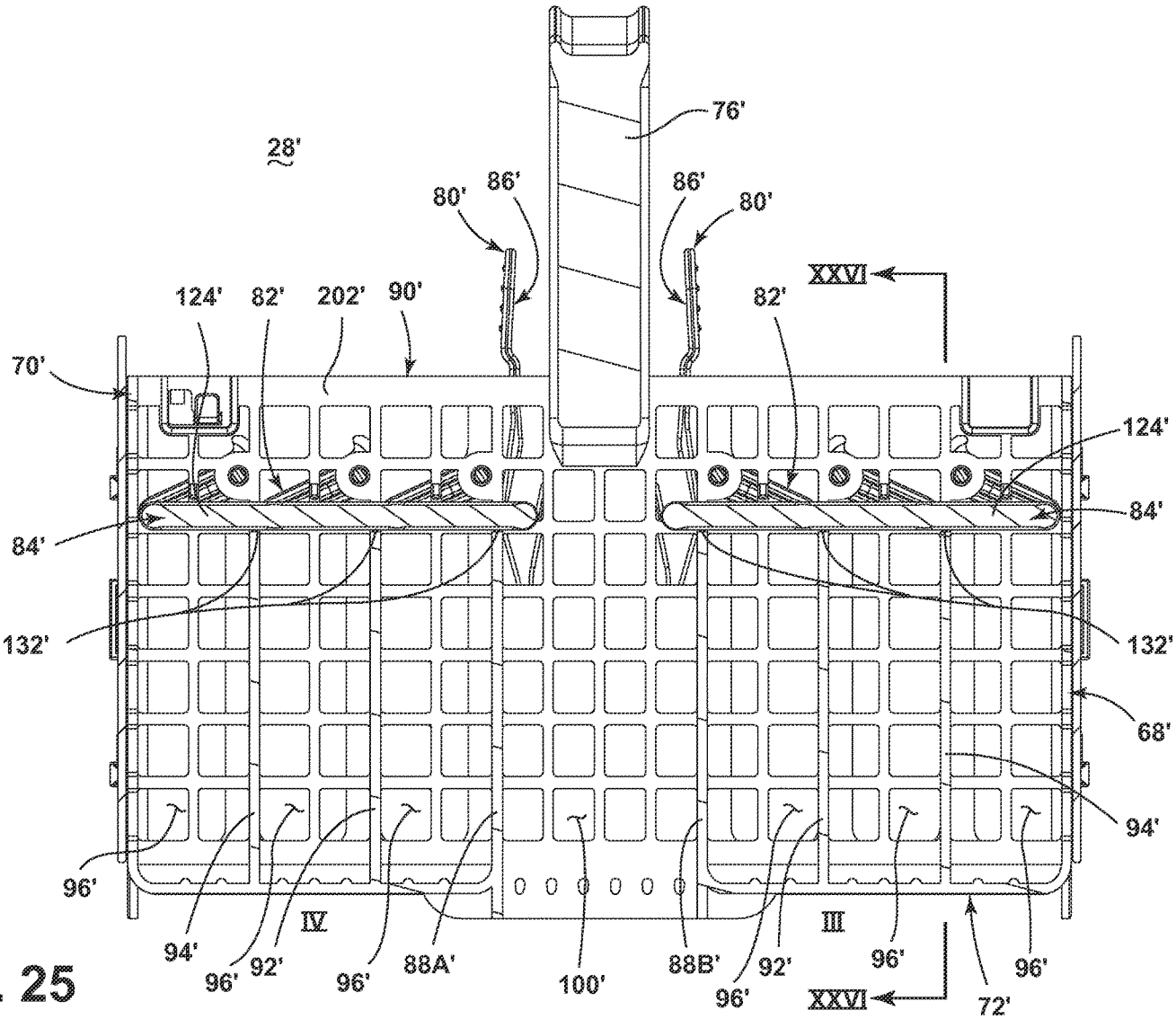
FIG. 25 is a cross-sectional view taken through line XV-XV of FIG. 19, showing the assembly of a utensil mover of the loading/unloading mechanism in the basket.
Figure 26:
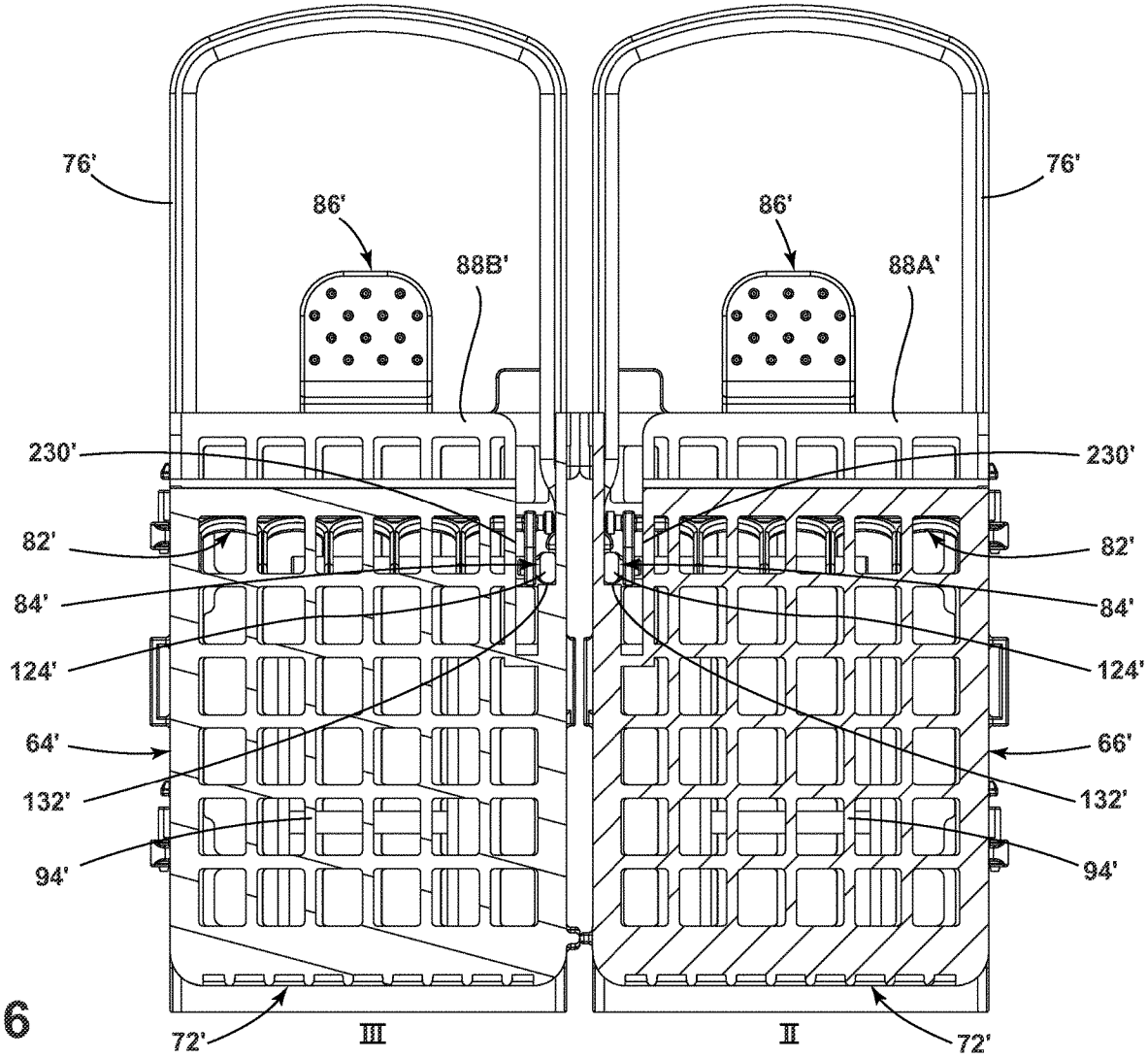
FIG. 26 is a cross-sectional view taken through line XVI-XVI of FIG. 25, also showing the assembly of the utensil mover in the basket.

FIG. 25 provides a sectional view through the longitudinal axis of the mover shaft 124' showing the positioning of the mover 84' within the basket 28'. In particular, rails are provided in each quadrant for slidingly supporting the shaft 124' of the mover 84' laterally within the basket 28'. The rails can be formed by ledges 132' located on each of the primary partitions 88A', 88B' and the secondary partitions 92', 94' adjacent the intersection of these partitions 88A', 88B', 92', 94' and the other primary partition 90'. Thus, as shown herein, each mover shaft 124' rests on three of the ledges 132', one on each of the secondary partitions 92', 94' and one on the primary partition 88A' or 88B' corresponding to the dedicated quadrant for the mover 84'. As best seen in the sectional view through the secondary partition 94' in FIG. 26, the ledges 132' can be recessed below the upper edges of the partitions 88A', 88B', 92', 94' within an open notch 230' such that the mover 84' can be inserted into the notch 230' from above for positioning the shaft 124' on the ledge 132' on each of the partitions 88A' or 88B', 92', 94' corresponding to the mover 84'. Collectively, the notches 230' and the ledges 132' of all the partitions 88A' or 88B', 92', 94' in a quadrant form a pocket for the mover 84'. In assembly, the mover 84' can be inserted in the basket 28' with the shaft 124' positioned in the pocket until it rests on the ledges 132' while also locating the actuator bar arm 126' within the mover coupler 112' (FIG. 23).

Figure 27:
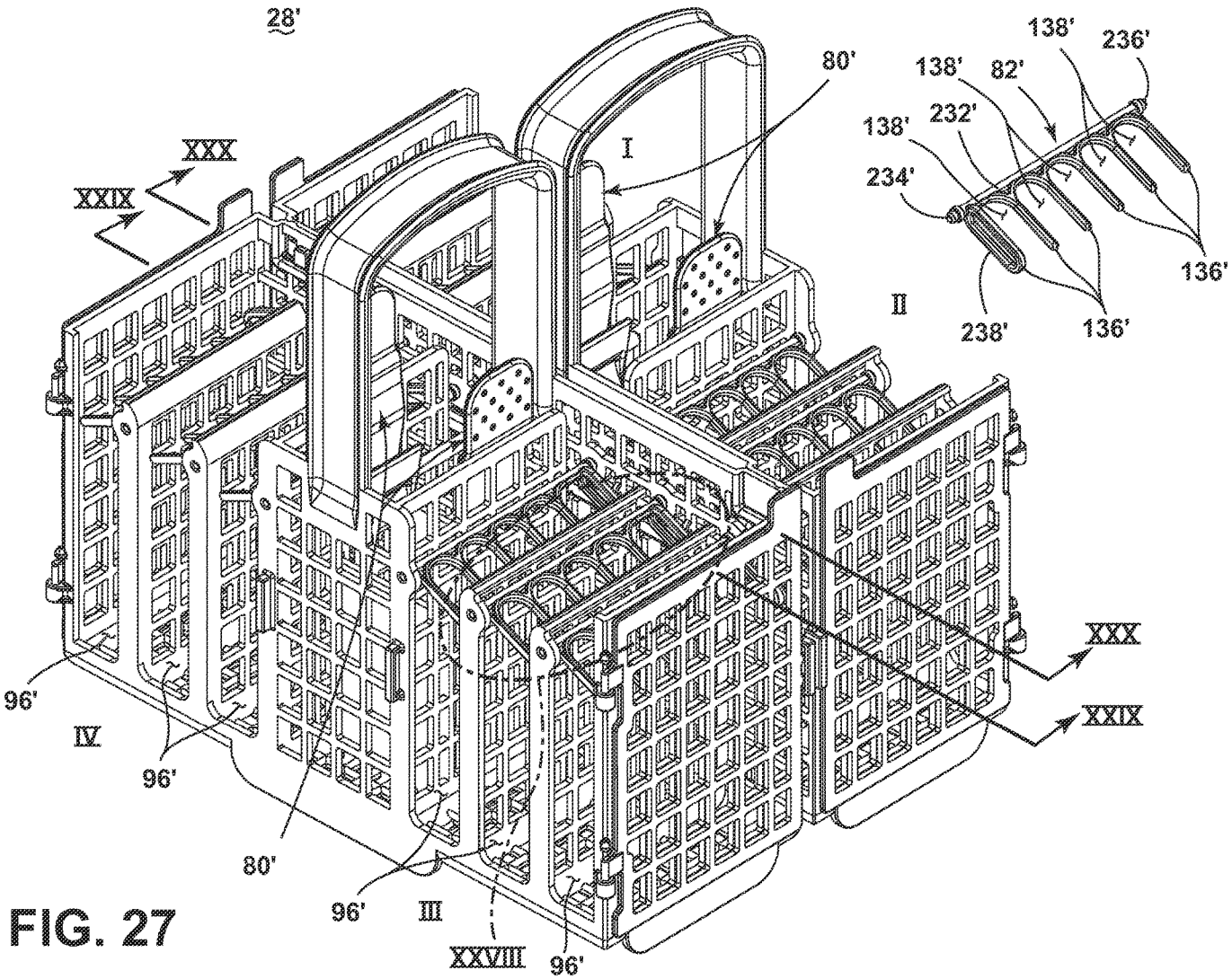
FIG. 27 is a perspective view of the utensil basket of FIG. 19, showing a loading grid of the loading/unloading mechanism exploded from the basket.

FIG. 27 illustrates one of the loading grids 82' exploded from the basket 28'. The loading grid 82' includes multiple dividers 136' spaced from each other to define multiple slots 138' configured to receive at least one utensil. The dividers 136' can be provided in the form of tines which define open-ended slots 138'. The loading grid 82' can form a partial closure for the utensil storage compartments 96' which effectively closes off a portion of the open top of the utensil storage compartments 96' with the dividers 136', while leaving a portion of the open top open or undivided by the dividers 136' by way of the slots 138'. The dividers 136' extend transversely from a common support in the form of a central rod 232' that terminates at a pivot pin 234', 236' at each end. The innermost divider 136', that is, the divider 136' closest to the mover 84', is in the form of an elongated track 238' operably coupled with the mover 84' (FIG. 24).

The slots 138' defined by the dividers 136' may be configured to receive a single utensil. This can provide gaps between adjacent utensils loaded into the grid 82', which may provide better cleaning action to the utensils and may prevent wear cause by utensils rubbing against each other during a cycle of operation. The dimensions of the slots 138' can further be configured to allow the handle of a utensil, but not the utility end, such as the tines in the case of forks or the bowl in the case of spoons, to pass between the dividers 136'. This exposes the utility end of the utensil to more of the cleaning action, as the utility end is not obstructed by any portion of the basket 28'. In conjunction with this, the height of the utensil storage compartments 96' can be configured so that the utensil is suspended above the bottom of the compartment when loaded into the grid 82'. In this configuration, the utensil effectively hangs within the basket 28' by its utility end. It is noted that a single, uniform grid configuration may not suspend all types of utensils. For example, the loading grid 82' can be configured with dividers that will suspend spoons and forks, but not knives.

Figure 28:
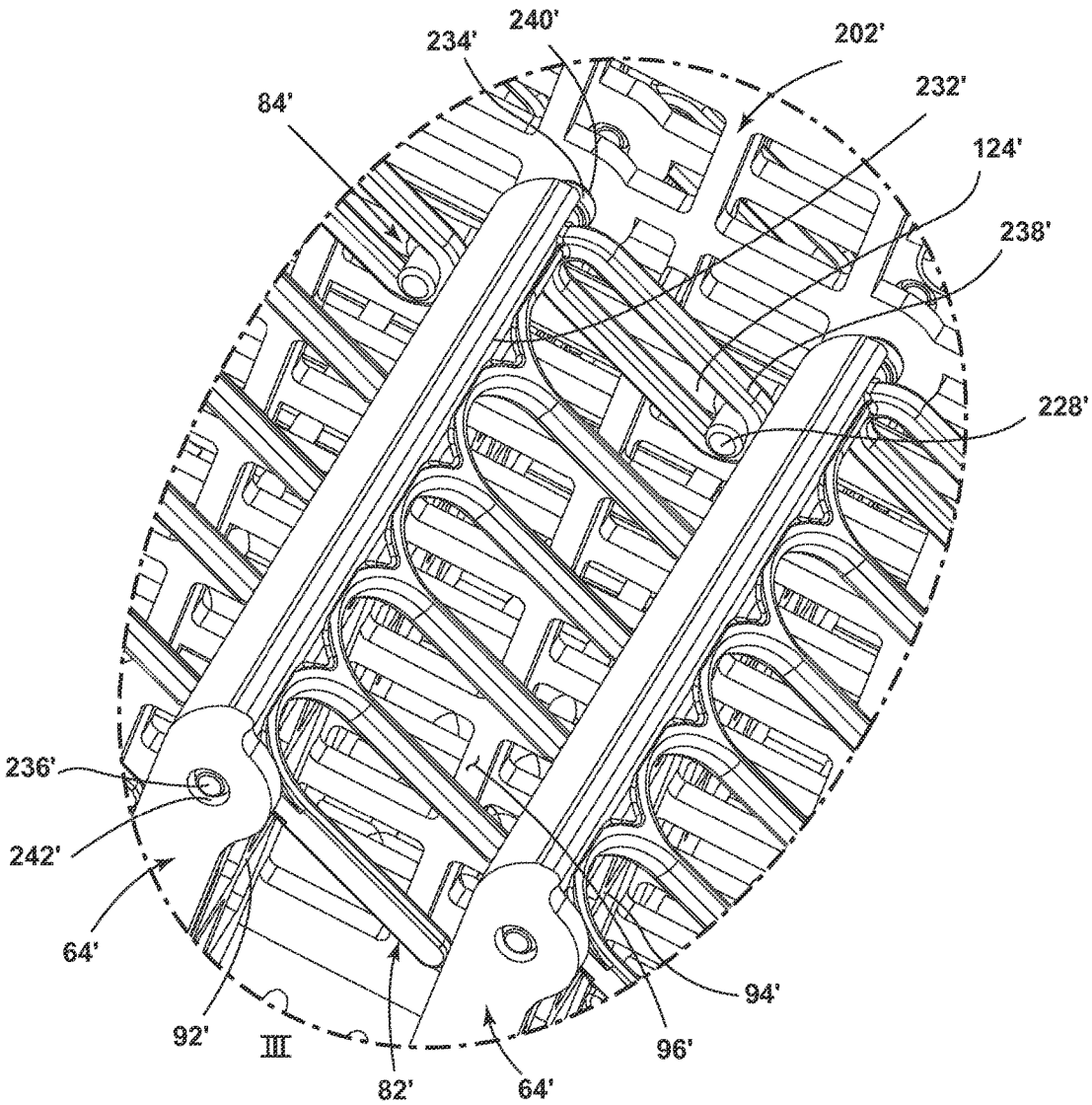
FIG. 28 is a close-up perspective view of the region labeled XXVIII in FIG. 27, showing the assembly of the loading grid with the basket.

Referring now to FIG. 28, which is an enlarged view of the region identified in FIG. 27, the basket 28' includes a pair of openings 240', 242' for mounting each loading grid 82' to the basket 28'. The first of the openings 240' is located on the inside wall 202', and the second of the openings 242' is positioned in the front wall 64' directly across from the first opening 240'. The openings 240', 242' are positioned at a height that conforms to the desired height from which to suspend the utensils in the utensil storage compartment 96'. The assembly of the loading grid 82' with the basket 28' occurs by placing the innermost pivot pin 234' into the first opening 240' and inserting the corresponding mover pin 228' into the elongated track 238', followed by placing the outermost pivot pin 236' into the second opening 242'. Such an arrangement allows for pivoting movement of the loading grid 82' relative to the utensil storage compartment 96' between the loading and unloading positions.

Figure 29:
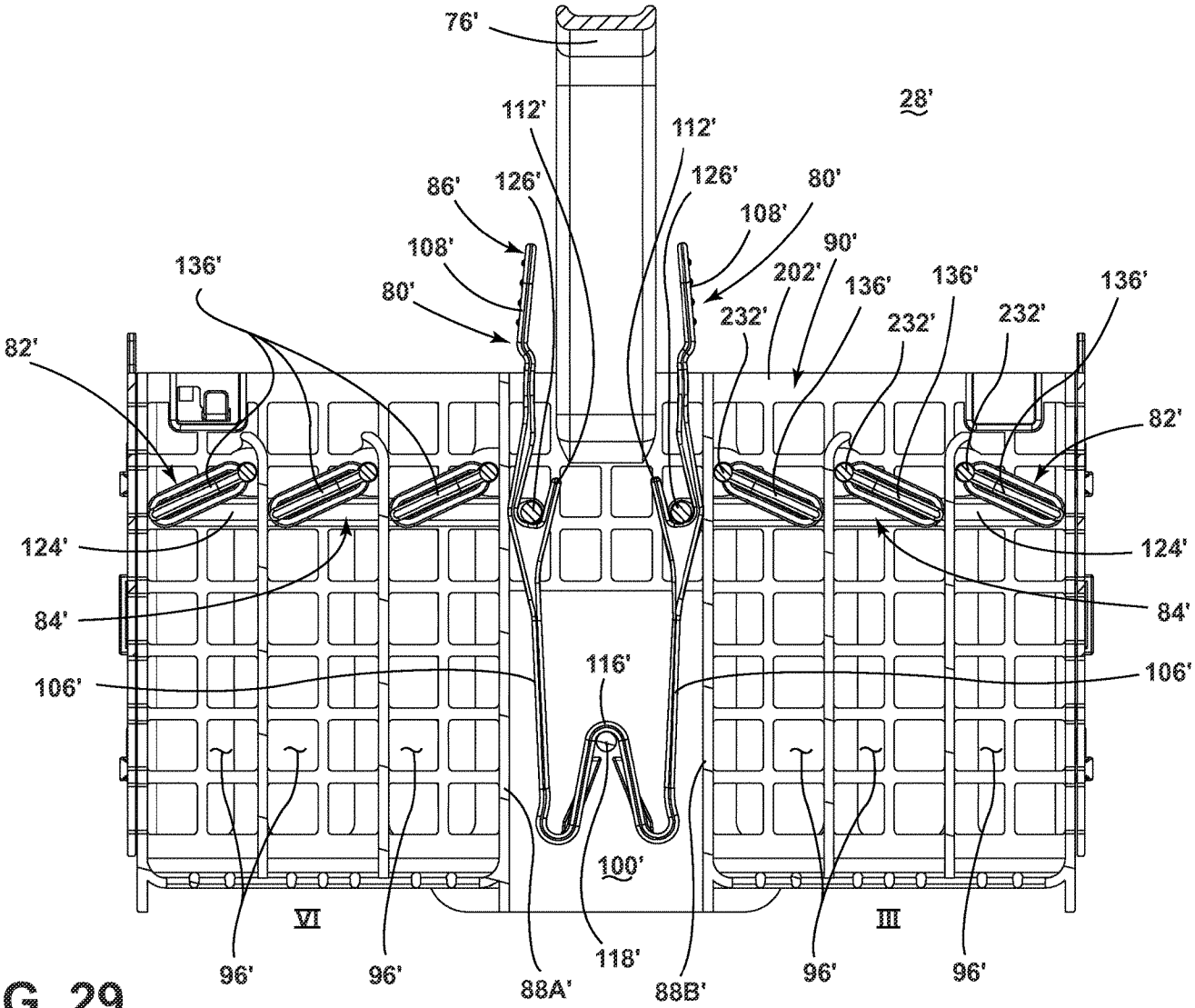
FIGS. 29 and 30 are sectional views taken through lines XXIX-XXIX and XXX-XXX, respectively, of FIG. 27, showing the loading/unloading mechanisms in a closed position.
Figure 30:
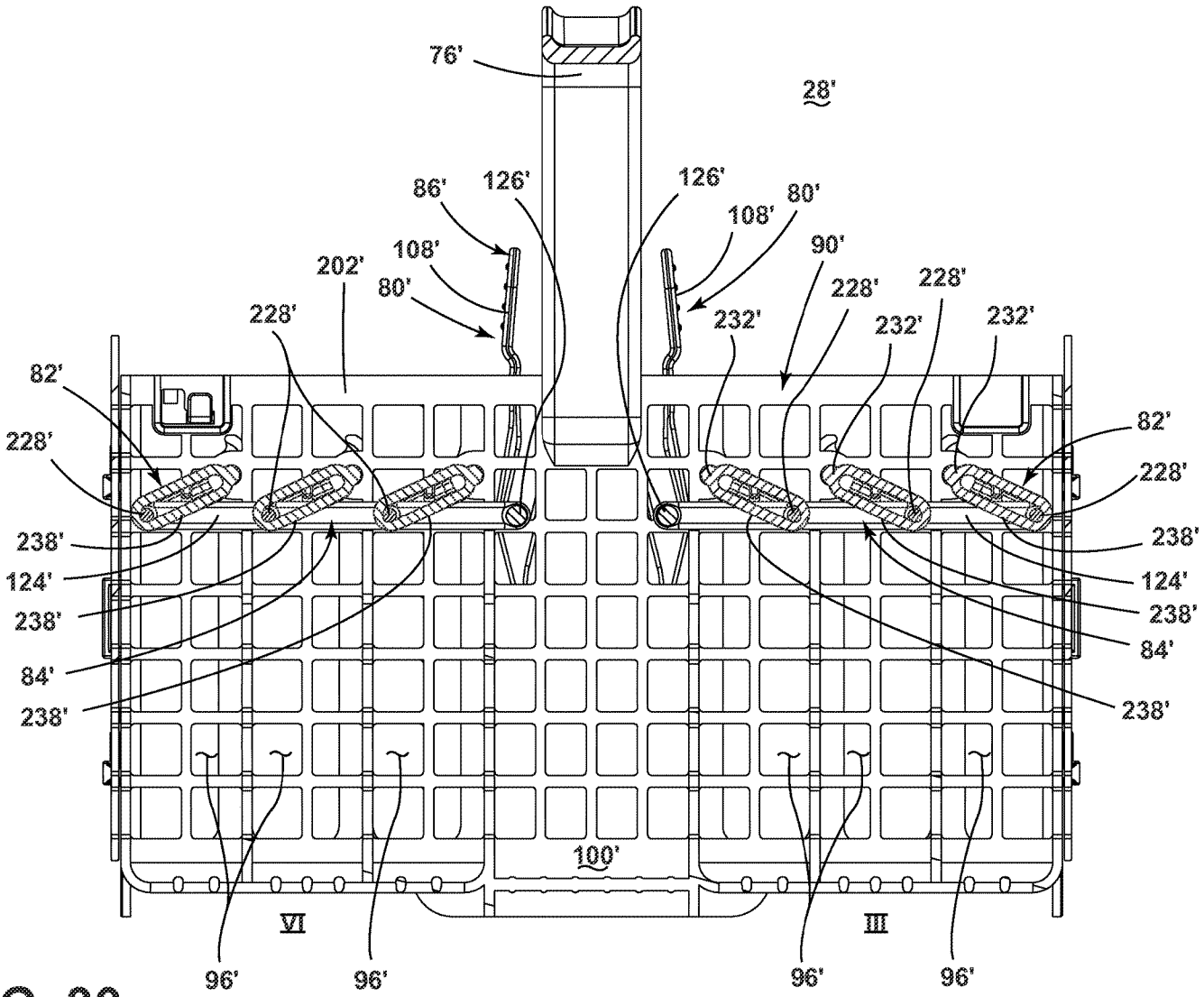
Figure 31:
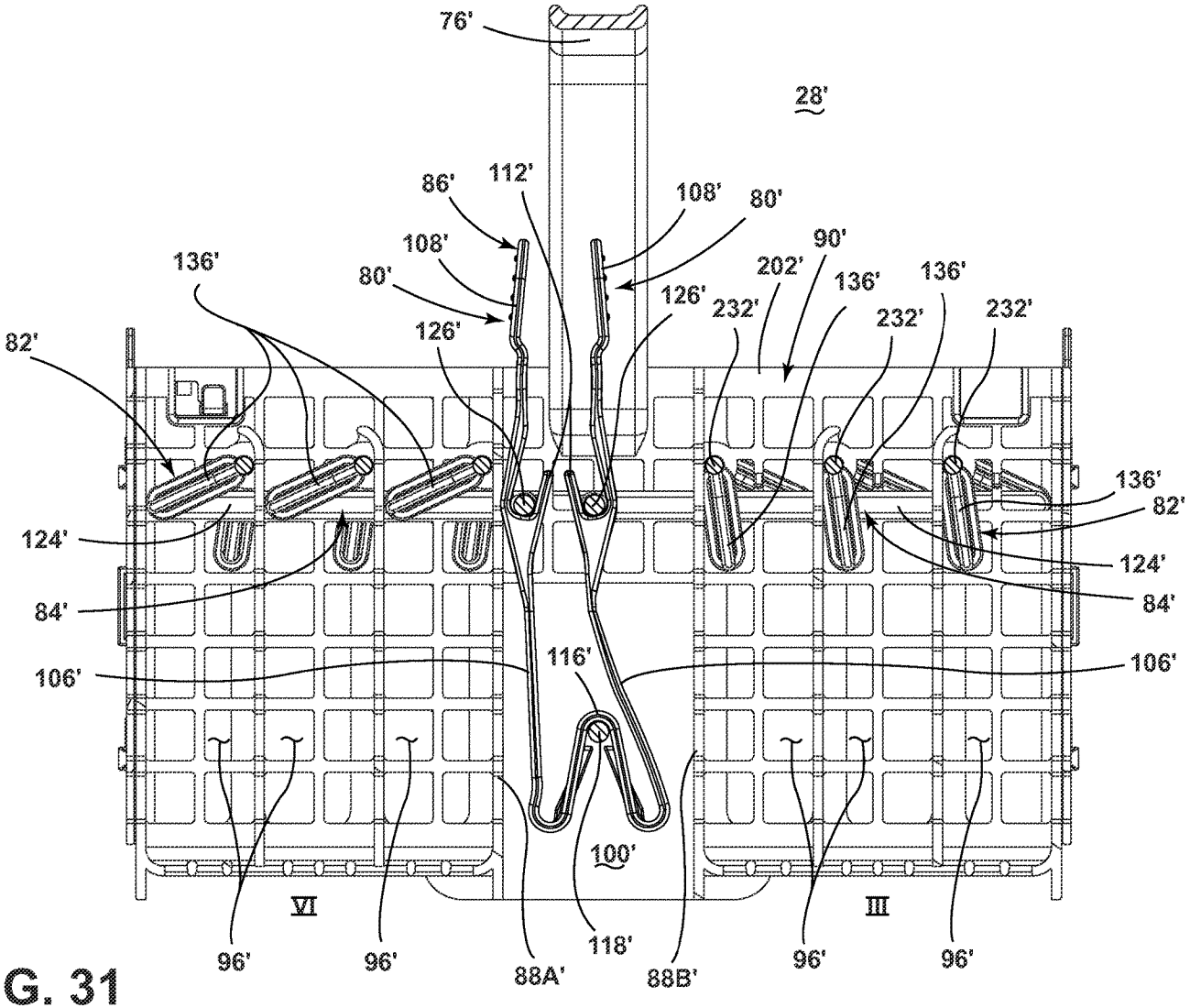
FIGS. 31 and 32 are sectional views similar to FIGS. 29 and 30, respectively, showing the loading/unloading mechanism of one quadrant in an open position.
Figure 32:
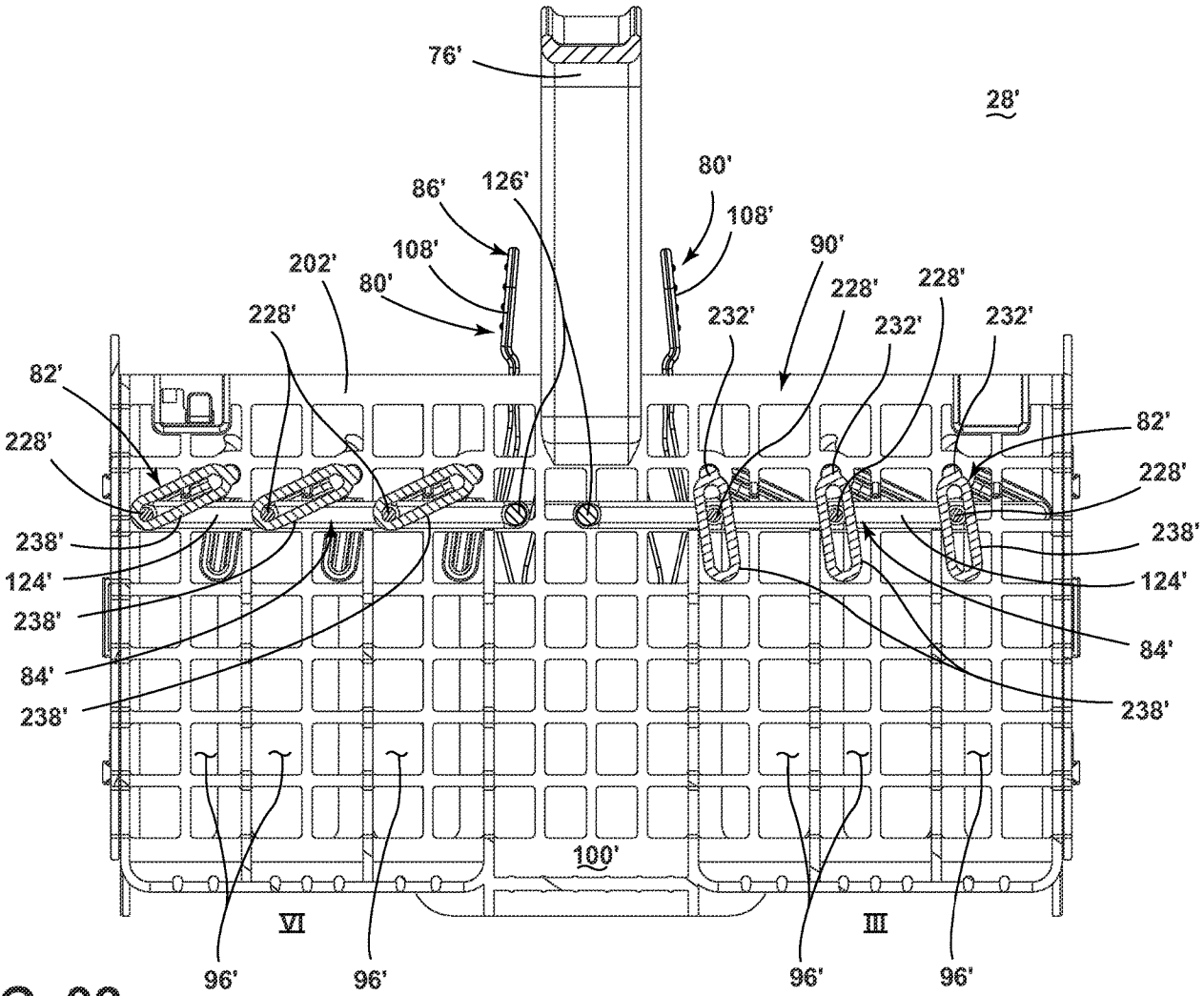

Operation of the loading/unloading mechanism 80' for the basket 28' is illustrated with respect to FIGS. 29-32. FIGS. 29 and 30 are sectional views of the utensil basket 28' taken along the lines identified in FIG. 27, showing the loading/unloading mechanism 80' in a closed, forced loading position. FIGS. 31 and 32 are similar sectional views of the utensil basket 28' showing the loading/unloading mechanism 80' in an open, unloading position. The operation is described with a focus on quadrants III and IV, with it being understood that the same operation can occur in other quadrants, independently or simultaneously with other quadrants or pairs of quadrants.

With reference to FIGS. 29 and 30, in the closed position, the levers 106' of the actuator 86' are biased away from each other and abut the respective first primary partitions 88A', 88B'. In turn, the lever 106' for the quadrant pushes the corresponding mover 84' away from the basket handle 76' and, thus, the mover pins 228' to the ends of the corresponding elongated tracks 238' on the loading grids 82'. As a result, the loading grids 82' are forced to the closed position partially closing the open tops of the utensil storage compartments 96' as described above.

As also noted above, the actuator 86' may be under a compressive force in the closed position in order to create a positive loading force on the mover 84 which can improve wash performance by maintaining the utensils in more or less the same position throughout the cycle of operation. Without the positive loading force, the utensils may shift around during cleaning.

With reference to FIGS. 31 and 32, in the open position, the lever 106' of the actuator 86', such as, for example, the illustrated lever 106' for quadrant III, is pressed away from the first primary partition 88B' and toward the basket handle 76', which in turn pulls the corresponding mover 84' toward the basket handle 76'. At the same time, as long as the user does not simultaneously press on the other lever 106' of the actuator 86', the other lever 106' remains in abutment with the other first primary partition 88A'. Pulling the mover 84' towards the handle 76' slides the mover shaft 124' within the pocket, thus sliding the mover pins 228' within the corresponding elongated tracks 238' and, thereby, forcing the loading grids 82' to pivot downward to the open position. In the open position, the loading grid 82' is generally vertically oriented within the utensil storage compartment 96' adjacent the corresponding primary partition 88A' or 88B' or secondary partition 92', 94'. If a user were to press the lever 106' for quadrant IV at the same time as the lever 106' for quadrant III, the levers 106' would be pressed towards each other away from their respective primary partitions 88A', 88B', thus simultaneously sliding the corresponding movers 84' to move the loading grids 82' to the open positions. Upon release of the lever 106', the level 106', under bias, moves back to the closed position of FIGS. 29 and 30.

Figure 33:
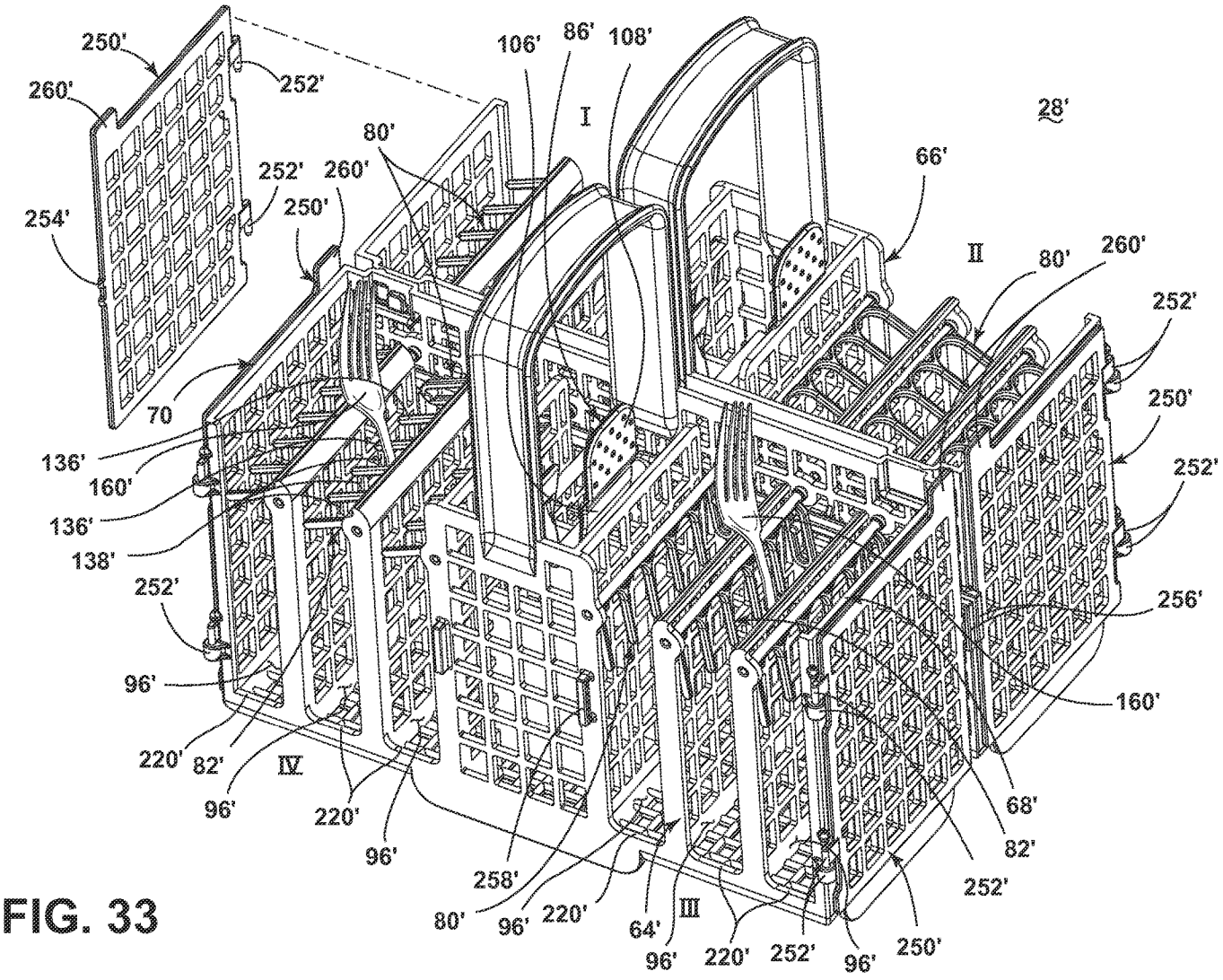
FIG. 33 is a perspective view of the basket of FIG. 19 loaded with two utensils, one in a quadrant with the loading/unloading mechanism in the closed position, and one in a quadrant with the loading/unloading mechanism in the open position, and also showing a closure element exploded from the basket.

In the perspective view of the basket in FIG. 33, the loading/unloading mechanisms 80' for quadrants I, II, and IV are closed, while the mechanism 80' for quadrant III is open. Quadrant IV includes a loaded fork 160' held in the closed loading grid 82', while quadrant III includes a fork 160' ready for unloading. To load the basket 28', the fork 160' is inserted into one of the slots 138' of the loading grid 82', with the utility end pointing upwardly, as shown in quadrant IV. Additional utensils may also be loaded into the basket 28' in a similar manner. After a cycle of operation has been run, a user can remove the basket 28' from the dishwasher 10 (FIG. 1) using the handle 76'. The user can open one of the quadrants, shown herein for illustrative purposes as quadrant III, by gripping the handle 76' in one hand and squeezing the lever 106' of the actuator 86' toward the handle 76' using a thumb or finger of the same hand pressed against the tab 108'. Without having to contact the utility end of the fork 160', the user can reach into the utility storage compartment 96' to remove the fork 160' by its handle, or else tilt the basket 28' to dump the fork 160' out of the basket 28' through the side opening 220' and onto another surface, such as a countertop, drawer, or tray. Release of the lever 106' by the tab 108' automatically moves the loading/unloading mechanism 80' back to the closed position, automatically readying the quadrant for loading once again.

Alternatively, the basket 28' may be employed for bulk loading of utensils rather than forced loading. Bulk loading can occur with the loading grids 82' in the open position, whereby the utensils can be placed in any location within the utensil storage compartment 96' rather than only in the slots 138' of the loading grid 82'. The basket 28' may be adapted to retain the loading/unloading mechanism 80' in the open position, if desired, for bulk loading. To prevent undesired removal of the utensils from the utensil storage compartments 96' through the side openings 220' for bulk loading, the basket 28' may include a closure element, such as a pivoting door 250', that selectively closes the side openings 220'. For example, each quadrant can be equipped with the door 250' sized to cover the side openings 220' for that quadrant. For ease of viewing all features of the door 250', the door 250' is shown exploded from the basket 28' in FIGS. 33 and 34. The door 250' can be mounted for movement between an open position, shown in FIG. 33, laying flat against one of the side walls 68', 70' spaced from the side openings 220', and a closed position, illustrated in FIG. 34 for quadrant III, against the front wall 64' (or rear wall 66' for quadrants I and II) blocking the side openings 220'. A hinge 252' or other suitable mechanism can movably mount the door 250' to the basket 28'. In the illustrated example, the hinge 252' has mating components located at the corner of the basket 28' and along one side edge of the door 250'. The door 250' can include a latch 254', illustrated as being positioned on the opposite side edge of the door 250' from the hinge 252', that operatively couples with a first catch 256' on the side wall 68' or 70' to retain the door 250' in the open position and a second catch 258' on the front wall 64' or the rear wall 66' to retain the door 250' in the closed position. A door handle 260', illustrated as a tab projecting upwardly from the door 250', may provide a convenient location for the user to grasp the door 250' for movement. The door 250' can also be used for forced loading, such as to ensure inadvertent removal of the utensils upon moving the loading/unloading mechanism 80' to the open position. In such a case, the door 250' can be placed the closed position until the user desires removal of the utensils through the side openings 220', at which time, the user can move the door 250' to the open position.

Figure 34:
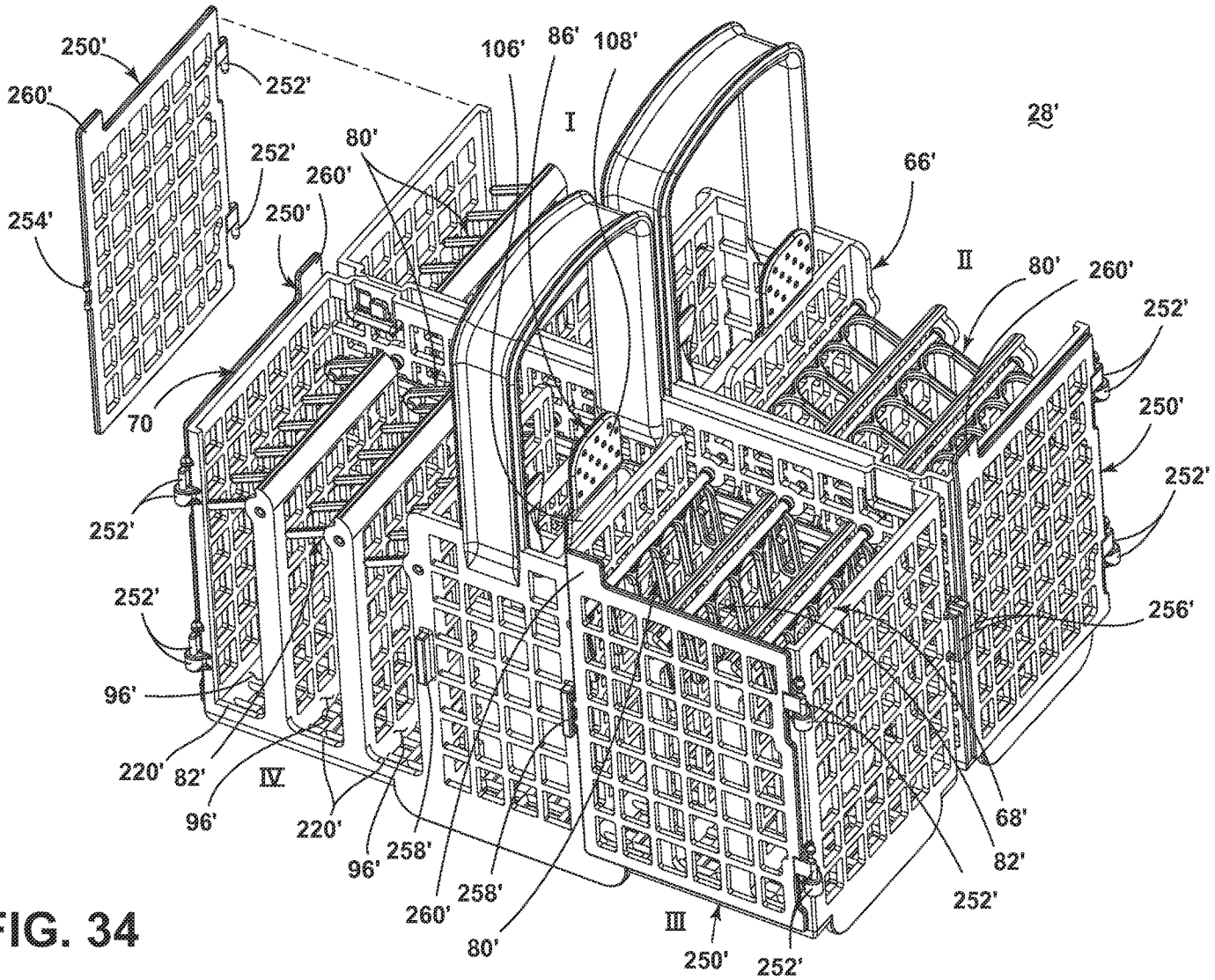
FIG. 34 is a perspective view of the basket similar to FIG. 33 with one of the closure elements in a closed position.

Advantageously, the embodiment of the basket 28' in FIGS. 19-34 can be arranged in multiple configurations. In one example, the basket 28' can be arranged with the four quadrants in a generally square or rectangular configuration, as depicted in FIG. 34, wherein the two half baskets 200' are connected to each other with the inside walls 202' adjacent one another and mounted together. Alternatively, the half baskets 200' can be separated from one another and arranged as desired in the dishwasher 10, such as in a linear arrangement or even in different dish racks 24, 26. The half baskets 200' can also be used alone, that is, just one of the half baskets 200' rather than both. In another alternative, the basket 28' may be made unitary with the four quadrants in a square or rectangular configuration, similar to the first embodiment of the basket 28, or perhaps a linear configuration. If the basket 28' includes the half baskets 200', each of the half baskets 200' can optionally be formed of a single molded body with the loading/unloading mechanism 80' and the door 250' formed as separate components mounted to the single molded body.

Additionally, while the utensil basket 28, 28' has been shown and described as being divided into four quadrants, it is contemplated that the basket 28, 28' can be divided into a different quantity of sections and is not limited to four sections. For example, the basket 28, 28' can be modified to include only one section, with or without multiple utensil storage compartments 96, 96' in the section. Alternatively, the basket 28, 28' may have two, three, or more than four sections, each having one or more than one utensil storage compartments 96, 96'. In other words, various configurations of sections and utensil storage compartments 96, 96' are feasible, and the basket 28, 28' is not limited to the quadrant configurations described above and shown in the figures. Further, when the basket 28, 28' is formed by half baskets 200', the half baskets 200' can have various configurations of sections and utensil storage compartments 96, 96'. Even further, the basket 28, 28' may be formed of more than two sub-baskets when the basket 28, 28' or may be formed of just one basket rather than sub-baskets, such as the half baskets 200'.

There are several advantages of the present disclosure arising from the various features of the apparatuses described herein. For example, the embodiments of the invention described above allow for organized loading and sanitary unloading of a utensil basket. Utensils in current utensil baskets are commonly unloaded one-by-one, which involves effort and time on the part of the user of the user of the dishwasher. For the sake of cleanliness, users may prefer to touch the handles of the utensils, rather than the utility end of the utensil. The utensil baskets of the present invention allow the user to unload the basket easily by operation of the loading/unloading mechanism. Multiple utensil items in the basket can be unloaded at once, minimizing the effort and time required on the part of the user. Also, the utensil baskets can be unloaded without contacting the utility end of the utensils.

Another advantage is that the embodiments of the invention described above allow for improved cleaning of the utensils by separating the utensils with the loading grid and providing a positive loading force on the utensils to prevent a large degree of movement during a cycle of operation.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A utensil basket for a dishwasher comprising:

at least one compartment having sidewalls and defining a pocket and a rail extending along at least a portion of an upper edge of the pocket;

a grid mounted to the compartment and overlying the pocket and having a plurality of spaced tines defining open-ended slots sized to receive individual utensils in an upright position with a handle of the utensil located within the at least one compartment; and a mover slideably supported by the rail and having an arm, the arm movably mounted to the utensil basket and moveable relative to the grid;

an actuator coupled to the mover and moving the mover between a loading position wherein the arm is spaced from the open ends of the slots and an unloading position wherein the arm is adjacent to the open ends of the slots;

wherein movement of the arm from the loading position to the unloading position is configured to release any utensils within the tines for grasping and removal by a user.

2. The utensil basket of claim 1, wherein the at least one compartment includes an open top and the grid forms a partial closure for the pocket.

3. The utensil basket of claim 1, and further comprising:

a bottom wall wherein the sidewalls extend upward from the bottom wall; and wherein at least one of the sidewalls includes at least one opening leading into the pocket, and any utensils within the basket can be removed from the basket through the at least one opening when the arm is in the unloading position.

4. The utensil basket of claim 3, wherein the actuator comprises a biasing member biasing the actuator toward the loading position.

5. The utensil basket of claim 4, and further comprising a handle facilitating removal of the basket from the dish treating appliance, wherein the actuator is biased away from the handle in the loading position.

6. The utensil basket of claim 4, wherein the actuator is under a compressive force in the loading position to provide a positive loading force on the mover.

7. The utensil basket of claim 1, wherein the grid is in a fixed position on the basket and the arm is moveable relative to the grid to such that movement of the arm from the loading position to the unloading position effects the movement of any utensils within the pocket away from the grid.

8. The utensil basket of claim 7, wherein the mover comprises a carrier aligned with the grid in the loading position and offset from the grid in the unloading position.

9. The utensil basket of claim 1, wherein the grid comprises a support coupled with the basket, and the tines extend transversely from the support.

10. The utensil basket of claim 1, wherein the at least one compartment comprises a loading compartment and an unloading compartment and movement of the mover from the loading position to the unloading position effects the movement of any utensils within the basket from the loading compartment to the unloading compartment.

11. The utensil basket of claim 10, wherein the unloading compartment comprises an opening for removal of utensils through the opening.

12. The utensil basket of claim 1, wherein the basket comprises multiple zones for loading utensils and each zone is provided with an individually-operable mover.

13. A utensil basket for a dishwasher comprising:

at least one compartment having sidewalls and defining a pocket having a rail on at least a portion of an upper edge; a grid mounted to the compartment and overlying the pocket and having a plurality of spaced tines defining open-ended slots sized to receive individual utensils in an upright position with a handle of the utensil located within the at least one compartment;

a mover having an arm, the mover movably mounted to the rail for relative movement between a loading position where the arm is spaced from the open ends of the slots and an unloading position wherein the arm is closer to the open ends of the slots, compared with the loading position; and an actuator configured to move the mover between the loading position and the unloading position;

wherein actuation of the mover arm from the loading position to the unloading position is configured to release any utensils within the tines by effecting a movement of the utensils toward the open ends of the slots for grasping and removal by a user.

* * * * *